US009720384B2

(12) United States Patent
Honda

(10) Patent No.: US 9,720,384 B2
(45) Date of Patent: Aug. 1, 2017

(54) RADIO SIGNAL RECEIVER, ELECTRONIC DEVICE, AND RADIO SIGNAL RECEIVING METHOD

(71) Applicant: Seiko Epson Corporation, Tokyo (JP)

(72) Inventor: Katsuyuki Honda, Miyata-Mura (JP)

(73) Assignee: Seiko Epson Corporation (JP)

( * ) Notice: Subject to any disclaimer, the term of this patent is extended or adjusted under 35 U.S.C. 154(b) by 176 days.

(21) Appl. No.: 14/693,311

(22) Filed: Apr. 22, 2015

(65) Prior Publication Data

US 2015/0311933 A1 Oct. 29, 2015

(30) Foreign Application Priority Data

Apr. 24, 2014 (JP) ..... 2014-090260

(51) Int. Cl.

| | |
|---|---|
| ***H04B 1/16*** | (2006.01) |
| ***H04B 1/38*** | (2015.01) |
| ***G04R 60/02*** | (2013.01) |
| ***G04R 20/04*** | (2013.01) |

(52) U.S. Cl.
CPC ..... *G04R 20/04* (2013.01)

(58) Field of Classification Search
CPC ..... H04B 1/1638; H04B 1/385; H04B 2001/3861; H04B 1/16; H04B 1/3827; G04R 60/02; G04R 20/04; G04R 20/08; G04G 21/04; G04G 1/00; G04G 1/06
See application file for complete search history.

(56) References Cited

U.S. PATENT DOCUMENTS 8,897,097 B2 11/2014 Baba et al.
2005/0157592 A1* 7/2005 Nakamura ..... G04R 20/08 368/47

FOREIGN PATENT DOCUMENTS

JP 2013-050343 A 3/2013

* cited by examiner

*Primary Examiner* — Pablo Tran
(74) *Attorney, Agent, or Firm* — Harness, Dickey & Pierce, P.L.C.

(57) ABSTRACT

A radio signal receiver includes a GPS receiver circuit, an environment detection circuit (charging state detection circuit and voltage detection circuit) that detects is in an environment suited to the radio signal receiver receiving satellite signals, and a control circuit. The control circuit has a first reception control unit that operates the GPS receiver circuit when the radio signal receiver is determined to be in an environment suited to receiving satellite signals based on the result output by the environment detection circuit, a second reception control unit that operates the GPS receiver circuit at a scheduled reception time, and a switching unit that switches operation between the first reception control unit and second reception control unit.

20 Claims, 21 Drawing Sheets

| DETECTED ILLUMINANCE LEVEL | OPEN CIRCUIT VOLTAGE OF SOLAR CELL (V) | ILLUMINANCE (lx) |
|---|---|---|
| 0 | 3.8 | 100 |
| 1 | 4.4 | 500 |
| 2 | 4.8 | 1,000 |
| 3 | 5.0 | 2,000 |
| 4 | 5.2 | 3,000 |
| 5 | 5.4 | 5,000 |
| 6 | 5.5 | 8,000 |
| 7 | 5.6 | 10,000 |
| 8 | 5.8 | 30,000 |
| 9 | 5.9 | 50,000 |
| 10 | 6.2 | 100,000 |

FIG. 10

| PRIORITY LEVEL | DETECTED ILLUMINANCE LEVEL | DETECTION TIME | DETECTION COUNT |
|---|---|---|---|
| 1 | 6 | 20:00 | 4 |
| 2 | 6 | 07:00 | 3 |
| 3 | 5 | 17:30 | 3 |
| 4 | 5 | 12:30 | 2 |
| 5 | 4 | 06:30 | 2 |
| 6 | 3 | 05:59 | 2 |

FIG. 14

| PRIORITY LEVEL | DETECTION TIME | DETECTION COUNT |
|---|---|---|
| 1 | 7:30 | 32 |
| 2 | 7:15 | 30 |
| 3 | 7:00 | 25 |
| 4 | 12:15 | 20 |
| 5 | 17:30 | 15 |
| 6 | 17:45 | 12 |

FIG. 17

| ORDER OF SUCCESSFUL RECEPTION | TIME OF SUCCESSFUL RECEPTION |
|---|---|
| 1 | 06:10 |
| 2 | 06:15 |
| 3 | 06:40 |
| 4 | 06:00 |
| 5 | 05:59 |
| 6 | 06:15 |
| 7 | 07:02 |
| 8 | 06:50 |
| 9 | 06:10 |
| 10 | 06:08 |

FIG. 19

| TIME | ATTEMPTED RECEPTION COUNT | SUCCESSFUL RECEPTION COUNT |
|---|---|---|
| 12:00～12:59 | 0 | 0 |
| 13:00～13:59 | 3 | 0 |
| 14:00～14:59 | 0 | 0 |
| 15:00～15:59 | 0 | 0 |
| 16:00～16:59 | 0 | 0 |
| 17:00～17:59 | 16 | 15 |
| 18:00～18:59 | 14 | 12 |
| 19:00～19:59 | 0 | 0 |
| 20:00～20:59 | 0 | 0 |
| 21:00～21:59 | 0 | 0 |
| 22:00～22:59 | 0 | 0 |
| 23:00～23:59 | 0 | 0 |
| 0:00～0:59 | 0 | 0 |
| 1:00～1:59 | 0 | 0 |
| 2:00～2:59 | 0 | 0 |
| 3:00～3:59 | 0 | 0 |
| 4:00～4:59 | 0 | 0 |
| 5:00～5:59 | 0 | 0 |
| 6:00～6:59 | 24 | 23 |
| 7:00～7:59 | 20 | 20 |
| 8:00～8:59 | 24 | 21 |
| 9:00～9:59 | 2 | 0 |
| 10:00～10:59 | 0 | 0 |
| 11:00～11:59 | 0 | 0 |

FIG. 20

| DAY | SUCCESSFUL RECEPTION COUNT |
|---|---|
| MONDAY | 25 |
| TUESDAY | 19 |
| WEDNESDAY | 17 |
| THURSDAY | 16 |
| FRIDAY | 20 |
| SATURDAY | 1 |
| SUNDAY | 0 |

FIG. 21

RADIO SIGNAL RECEIVER, ELECTRONIC DEVICE, AND RADIO SIGNAL RECEIVING METHOD

BACKGROUND

1. Technical Field

The present invention relates to a radio signal receiver that receives radio frequency signals, an electronic device, and a radio signal receiving method.

2. Related Art

An example of a radio signal receiver that receives satellite signals and other RF signals, determines if the radio signal receiver is outdoors, and receives signals if the receiver is determined to be outdoors is described, for example, in JP-A-2013-50343.

The wrist watch disclosed in JP-A-2013-50343 has a solar panel, and determines if the wristwatch is outdoors or not based on the power output of the solar panel. The wristwatch receives satellite signals if the wristwatch is determined to be outdoors. If the wristwatch is determined to be indoors and not outdoors, and continues to be indoors for a predetermined time or longer, the wristwatch receives satellite signals at a previously set scheduled reception time.

Wasteful consumption of power can therefore be suppressed when the wristwatch is indoors where the possibility of failing to receive satellite signals is high because the satellite signals are not received unless the wristwatch remains indoors for at least a specific time. On the other hand, when the wristwatch is outdoors but cannot be determined to be outdoors because the wristwatch is covered by a sleeve or because the amount of light reaching the wristwatch is weak due to seasonal or weather-related factors, satellite signals are received at a preset scheduled reception time when this state continues for a specific time or longer.

However, when the user wearing the wristwatch disclosed in JP-A-2013-50343 is in a location with good light exposure for only a short time and then moves indoors, the wristwatch may be determined to be outdoors and reception may begin, but then cannot correctly receive the satellite signals because moving indoors makes reception impossible. Power is therefore wasted by the reception attempt.

Furthermore, because an outdoors location is not determined unless the wristwatch is exposed to outdoor light, the possibility that the wristwatch will be determined to be outdoors during a specific time will be low if the wristwatch is only used at night. This specific time is 24 hours, and reception at the scheduled reception time only occurs once a day. As a result, when the wristwatch is only used at night, the possibility that the next reception will not occur at the next scheduled reception time but at the scheduled reception time next after the specific time (24 hours) has past is high. As a result, when the wristwatch is used primarily at night, the average reception interval becomes longer than the interval between the scheduled reception times.

SUMMARY

A radio signal receiver, an electronic device, and a radio signal reception method according to the invention can suppress an increase in the reception interval while reducing power consumption.

One aspect of the invention is a radio signal receiver that receives radio signals, including: a reception circuit that receives the signals; an environment detection circuit that detects whether or not the radio signal receiver is in an environment suited to signal reception; and a control circuit that controls the reception circuit and the environment detection circuit, and includes a first reception control unit that operates the reception circuit when the radio signal receiver is determined to be in an environment suited to signal reception based on the detection result from the environment detection circuit, a second reception control unit that operates the reception circuit at a preset scheduled reception time, and a switching unit that switches operation between the first reception control unit and second reception control unit.

A radio signal receiver in this aspect of the invention is a wristwatch with a solar cell and an environment detection circuit that, based on the power output of the solar cell, determines if the radio signal receiver is in an environment suited to receiving radio signals.

The control circuit in this aspect of the invention has a switching unit that switches operation between a first reception control unit and a second reception control unit, and can therefore switch operation between the first reception control unit and second reception control unit appropriately to how the radio signal receiver is used. More specifically, the control circuit can operate only one of the first reception control unit and second reception control unit.

If the first reception control unit operates, reception occurs when the radio signal receiver is in an environment suited to signal reception, such as outdoors, and reception is therefore easy. Because reception is not attempted when the radio signal receiver is not in an environment suited to signal reception and the likelihood of reception failing is high, wasteful power consumption can be suppressed.

When the second reception control unit operates, reception is only attempted at the scheduled reception time. As a result, because reception does not start when the user wearing the radio signal receiver is in a location exposed to outdoor light for only a short time and then moves indoors, wasteful power consumption can be suppressed. Yet further, because reception is attempted at the scheduled reception time when the radio signal receiver is used primarily at night, the average reception interval becoming longer than the interval between scheduled reception times can be prevented.

By switching between operation of the first reception control unit and the second reception control unit based on how the radio signal receiver is used, signals can be easily received successfully, power consumption can be reduced, and the after interval between receptions can be prevented from becoming longer than the interval between scheduled reception times.

A radio signal receiver according to another aspect of the invention also has an input device, and the switching unit switches operation between the first reception control unit and second reception control unit based on input to the input device.

Thus comprised, the user can switch operation between the first reception control unit and second reception control unit at the time best suited to the user's regular schedule of activity by simply operating the input device.

Further preferably in a radio signal receiver according to another aspect of the invention, the switching unit switches operation between the first reception control unit and second reception control unit based on a reception history, which is a history of reception by the reception circuit.

A radio signal receiver such as a wristwatch is typically used by habit. As a result, if the success rate of reception (reception based on evaluating the reception environment) attempted when the radio signal receiver is determined to be in an environment suited to signal reception, such as outdoors, is high, the probability of success in such environmentally-based reception when the first reception control unit operates is can be expected to be high and the likelihood of wasteful power consumption low. If the frequency of such environmentally-based reception is high, the likelihood that environmentally-based reception will be attempted during a specific time when the first reception control unit operates can be expected to be high, and the likelihood that the average reception interval will become longer than the interval between scheduled reception times low.

Therefore, by the switching unit referencing the reception history, operating the first reception control unit if the success rate and frequency of environmentally-based reception are relatively high, and otherwise operating the second reception control unit, operation can be switched between the first reception control unit and second reception control unit at the appropriate timing. Ease of use can also be improved because operation can be switched automatically between the first reception control unit and second reception control unit, and user input to the input device Further preferably in a radio signal receiver according to another aspect of the invention, the first reception control unit operates the reception circuit at the scheduled reception time when the radio signal receiver is determined to not be in an environment suited to signal reception continuously for a specific time or longer.

When the first reception control unit operates in this aspect of the invention, signal reception is driven at the scheduled reception time if the radio signal receiver is in an environment suited to signal reception, such as outdoors, but cannot be determined to be in an environment suited to signal reception because the light incident to the radio signal receiver is weak, for example, and this condition continues for a specific time or more.

Further preferably in a radio signal receiver according to another aspect of the invention, the first reception control unit stops operation of the environment detection circuit and operates the reception circuit at the scheduled reception time when the radio signal receiver is determined to not be in an environment suited to signal reception continuously for a specific time or longer.

If the radio signal receiver is determined to be in an environment not suited to signal reception continuously for a specific time or longer, the user may be wearing a winter jacket and the electronic timepiece may be covered by a sleeve everyday, for example. The possibility of detecting that the radio signal receiver is in an environment suited to signal reception, such as outdoors, is low even if the environment detection circuit operates, and power is wasted.

Therefore, if radio signal receiver is determined to be in an environment not suited to signal reception continuously for a specific time or longer, the invention reduces unnecessary power consumption by receiving signals only at the scheduled reception time without operating the environment detection circuit.

Further preferably in a radio signal receiver according to another aspect of the invention, after operating the reception circuit, the first reception control unit does not operate the reception circuit at the scheduled reception time when the radio signal receiver is determined to not be in an environment suited to signal reception continuously for a specific time or longer, and operates the reception circuit time when the radio signal receiver is determined to be in an environment suited to signal reception.

While the operating environment is not considered during reception at the scheduled reception time, the probability of reception succeeding can be improved by appropriately setting the scheduled reception time. However, reception with a high probability of success is possible by controlling reception based on the detection result from the environment detection circuit.

Because this aspect of the invention controls reception after signals are received based on the detection result of the environment detection circuit, which has a higher possibility of success than reception at the scheduled reception time, signals can be received while consuming less power than when both scheduled reception and reception based on the detection result of the environment detection circuit are used.

Further preferably in a radio signal receiver according to another aspect of the invention, the first reception control unit sets the time of successful signal reception when the radio signal receiver is determined to be in an environment suited to signal reception as the scheduled reception time.

The daily pattern of life of the user of the radio signal receiver is generally substantially the same, and is typically reflected in the environment detection result.

This aspect of the invention can improve the probability of successful reception by receiving signals at the time of successful reception when reception is attempted based on determining the radio signal receiver is in an environment suited to signal reception, such as outdoors.

Further preferably in a radio signal receiver according to another aspect of the invention, the first reception control unit and second reception control unit operate the reception circuit when a manual reception command is asserted, and set the time of successful signal reception initiated by a manual reception command as the scheduled reception time.

The possibility of success is high when signals are received outdoors. The possibility that the user is outdoors is also high when reception is started in response to the user operating the input device. If the user's pattern of daily life is basically the same everyday as described above, and reception is started manually when outdoors while commuting to work, the possibility is high that the user is outdoors at the time reception is started manually.

This aspect of the invention can therefore increase the probability of successful reception by receiving signals at the time when manual reception is instructed.

Yet further preferably, a radio signal receiver according to another aspect of the invention also has a storage unit; the first reception control unit and the second reception control unit store the reception success time in the storage unit, and when a plurality of reception success times are stored, set the success time with the highest reception success count as the scheduled reception time.

The possibility the user is outdoors is likely high at the time reception succeeds.

By attempting reception at the time with the highest success count selected from among the times when reception succeeded in the past, this aspect of the invention can time reception to when the possibility that the user is outdoors is high, and can thereby increase the probability of reception succeeding.

Further preferably in a radio signal receiver according to another aspect of the invention, when signal reception fails at the scheduled reception time, the first reception control unit and second reception control unit set the success time with the highest success count selected from among the success times other than the success time that was set as the scheduled reception time as the scheduled reception time, and do not change the scheduled reception time when signal reception at the scheduled reception time succeeds.

When reception fails at the scheduled reception time with the highest success count, this aspect of the invention sets the success time with the highest success count selected from among the success times other than the success time that was set as the scheduled reception time as the scheduled reception time, and can therefore increase the probability that reception will succeed the next time even if the user's daily pattern changes.

Further preferably in a radio signal receiver according to another aspect of the invention, the first reception control unit and second reception control unit determine in which of plural time periods set at a specific time interval the success time is contained, and set a specific time in the time period containing the success time as the scheduled reception time.

This aspect of the invention sets a specific time in the time period containing the success time as the scheduled reception time instead of simply setting the success time directly as the scheduled reception time, and can therefore reduce the number of scheduled reception times to manage. The user can also know the scheduled reception time more easily.

Further preferably in a radio signal receiver according to another aspect of the invention, the first reception control unit starts controlling the reception circuit and environment detection circuit at a preset start control time, starts control at the next start control time if the reception circuit is not operated before the next start control time, and if the reception circuit is operated, starts control at a start control time after a previously set time passes from the next control start time.

When the remaining battery capacity becomes low due to signal reception, this aspect of the invention does not attempt reception again for a predetermined set time after the next start control time. As a result, when the radio signal receiver is used in an electronic device that charges a battery with electrical energy converted by a solar cell, for example, the battery can be charged during the time when signals are not received, and the problem of running out of power during reception can be suppressed. In addition, when the remaining battery power is high because signals were not received, reception resumes at the next time control starts and satellite signals can be received promptly.

A radio signal receiver according to another aspect of the invention preferably also has: a solar cell; an illuminance detection circuit that detects the illuminance of light incident to the solar cell; and a storage unit. The control circuit operates the illuminance detection circuit at a specific time interval, stores the illuminance detected by the illuminance detection circuit and the illuminance detection time in the storage unit, and sets the detection time of the highest illuminance in a specific period as the scheduled reception time.

The higher the illuminance, the more likely the radio signal receiver will be located where there are few buildings or other objects obstructing satellite signals.

This aspect of the invention increases the probability of successful reception by starting reception at a time when the radio signal receiver is in a location where there are few obstructions to satellite signals.

Further preferably in a radio signal receiver according to another aspect of the invention, the control circuit sets the detection time of the illuminance that was detected the most times as the scheduled reception time when there are plural detection times for the highest detected illuminance.

By timing reception to the time with the highest reception count selected from among the detection times when illuminance was high in the past, reception can be timed to when the possibility is strong that the user is outdoors, and the probability of successful reception can be improved.

Further preferably, a radio signal receiver according to another aspect of the invention also has: a solar cell; an illuminance detection circuit that detects the illuminance of light incident to the solar cell; and a storage unit. The control circuit operates the illuminance detection circuit at a specific time interval, stores the detection time of the illuminance in the storage unit when the illuminance detected by the illuminance detection circuit is greater than or equal to a preset first threshold value, and sets the detection time stored in the storage unit as the scheduled reception time.

This aspect of the invention can increase the probability of successful reception by selecting the detection time when illuminance was greater than or equal to a first threshold value in the past as the reception time. In addition, by setting the first threshold value to a value enabling detecting that the user is in an environment suited to signal reception, such as outdoors, reception can be scheduled for a time when the user is in an environment suited to signal reception.

Further preferably in a radio signal receiver according to another aspect of the invention, when plural detection times are stored, the control circuit sets the detection time at which the illuminance was detected the most times as the scheduled reception time.

By scheduling reception to the time with the highest detection count when there are plural times when the illuminance was greater than or equal to the first threshold value in the past, this aspect of the invention can control reception timed to when the possibility that the user is outdoors is high, and the probability of successful reception can be increased.

Further preferably in a radio signal receiver according to another aspect of the invention, the control circuit determines which of plural time periods set at a specific time interval contains the detection time, and stores a specific time in the time period containing the detection time in the storage unit.

This aspect of the invention stores a specific time in the time period containing the detection time as the detection time instead of simply storing the detection time directly, and can therefore reduce the number of scheduled reception times to manage and minimize the required storage capacity in the storage unit. The user can also know the scheduled reception time more easily.

A radio signal receiver according to another aspect of the invention preferably also has a solar cell; the environment detection circuit is an illuminance detection circuit that detects the illuminance of light incident to the solar cell as the detection process detecting if the radio signal receiver is in an environment suited to signal reception; and the first reception control unit determines that the radio signal receiver is in an environment suited to signal reception when the illuminance detected by the illuminance detection circuit is greater than or equal to a preset second threshold value, and determines the radio signal receiver is not in an environment suited to signal reception when the detected illuminance is less than the second threshold value.

Illuminance differs greatly during the day between indoor lighting and sunlight.

By determining whether the device is in an environment suited to signal reception, such as outdoors, or not based on the illuminance of light incident to the solar cell, this aspect of the invention can desirably differentiate between outdoors and indoors during the day, and can increase the probability of successful reception.

Further preferably in a radio signal receiver according to another aspect of the invention, the signal is a satellite signal.

Thus comprised, the radio signal receiver can receive satellite signals through the reception circuit, and can acquire information for calculating the location of the radio signal receiver, including the time information and satellite orbit information contained in the received satellite signals.

Another aspect of the invention is an electronic device including the radio signal receiver described above.

This aspect of the invention has the same effect as the radio signal receiver described above.

Another aspect of the invention is a radio signal receiving method of a radio signal receiver that receives signals, including: a first reception control step of receiving the signal when the radio signal receiver is determined to be in an environment suited to signal reception; a second reception control step of receiving the signal at a previously set scheduled reception time; and a switching step of switching between the first reception control step and the second reception control step.

This aspect of the invention has the same effect as the radio signal receiver described above.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 10 shows the relationship between the open circuit voltage of the solar cell and the illuminance of light incident to the solar cell at different detected illuminance levels.

FIG. 14 shows the relationship between the detection time and detection count at each of the detected illuminance levels used to set the scheduled reception time in the fourth embodiment of the invention.

FIG. 17 shows the detection count at each detection time used to set scheduled reception in the fifth embodiment of the invention.

FIG. 19 shows reception success times used to set the scheduled reception time in a first variation of the invention.

FIG. 20 shows the relationship between the attempted reception count and the successful reception count in different time periods used to set the scheduled reception time in a second variation.

FIG. 21 shows the relationship between the successful reception count on different days of the week used to set the scheduled reception time in a third variation.

DESCRIPTION OF EMBODIMENTS

Preferred embodiments of the present invention are described below with reference to the accompanying figures.

Embodiment 1

Basic GPS Configuration Including an Electronic Device

Figure 1:
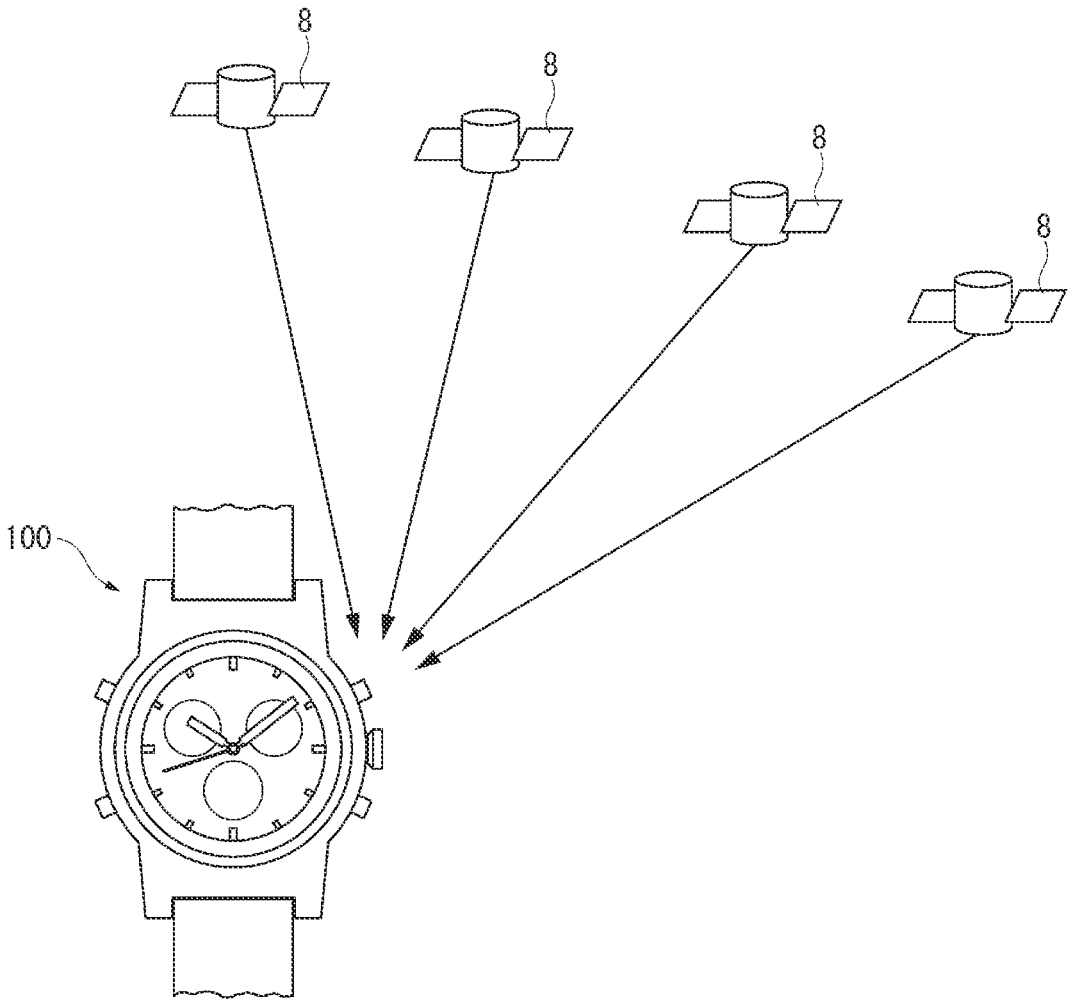
FIG. 1 illustrates the configuration of the Global Positioning System (GPS) including an electronic device.

FIG. 1 illustrates the basic configuration of the Global Positioning System (GPS) including an electronic device 100 according to the first embodiment of the invention. The basic configuration of the GPS whereby an electronic device 100 can acquire positioning information and time information for the current location using signals transmitted from an external source is described first below.

The electronic device 100 that adjusts the internal time based on RF signals (satellite signals) received from GPS satellites 8, and displays the time on the opposite side (the face) as the side worn in contact with the wrist (the back).

The GPS satellites 8 are navigational satellites that orbit the Earth in space on specific orbits, and broadcast a navigation message superimposed on a 1.57542 GHz carrier wave (L1 wave). For brevity below, the 1.57542 GHz carrier wave to which the navigation message is superimposed is referred to as the satellite signal. The satellite signals are right-hand circularly polarized waves.

There are presently 31 GPS satellites 8 in orbit (only 4 are shown in FIG. 1), and to identify which of the GPS satellites 8 transmitted the received satellite signal, a unique 1023 chip (1 ms) pattern called a C/A code (Coarse/Acquisition Code) is superimposed on the signal by each GPS satellite 8. Each chip in the C/A code denotes a +1 or −1, and the C/A code appears as a pseudorandom pattern. Therefore, by determining the correlation between the satellite signal and the pattern of each C/A code, the C/A code superimposed on a particular satellite signal can be detected.

Each GPS satellite 8 carries an atomic clock, and extremely precise GPS time information that is kept by the atomic clock is embedded in each satellite signal. The slight time difference between the atomic clocks carried by the GPS satellites 8 is measured by a land-based control segment, and a time correction parameter for correcting the particular time difference is included in each satellite signal.

The electronic device 100 receives a satellite signal transmitted from one GPS satellite 8, and sets the internal time of the electronic device 100 to the precise time (time information) obtained using the GPS time information and time correction parameter contained in the received satellite signal.

Orbit information identifying the location of the GPS satellite 8 on its orbit is also contained in the satellite signal. The electronic device 100 performs a positioning calculation using the GPS time information and orbit information. This positioning calculation assumes there is a certain amount of error in the internal time of the electronic device 100.

More specifically, in addition to the x, y, z parameters for acquiring the location of the electronic device 100 in three dimensions, the time difference is also an unknown variable. The electronic device 100 therefore generally receives satellite signals transmitted from four or more GPS satellites 8, and runs the positioning calculation using the GPS time information and orbit information contained in the received satellite signals to obtain the location information of the current location.

Basic Configuration of the Electronic Device

Figure 2:
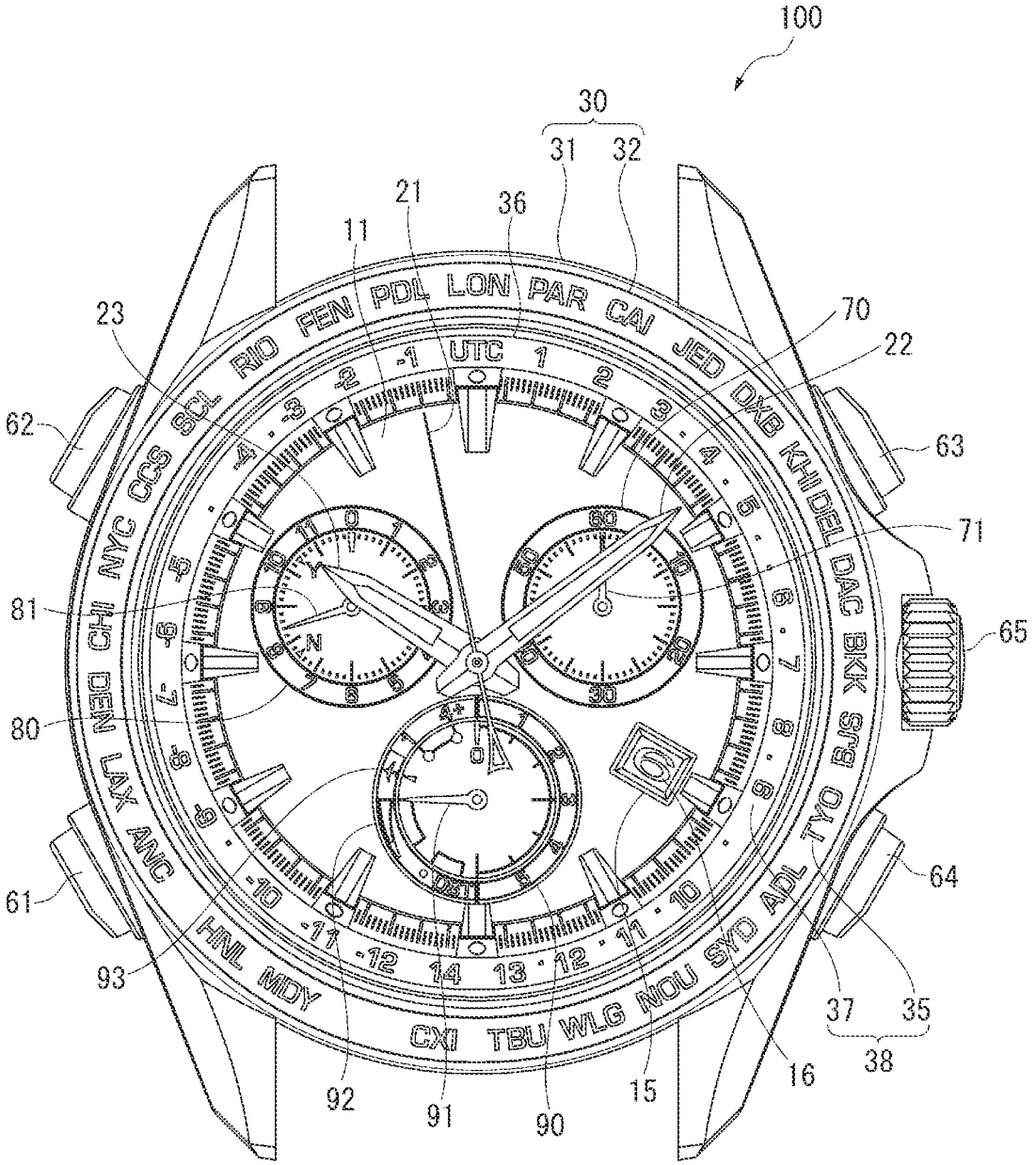
FIG. 2 is a plan view of an electronic device.
Figure 3:
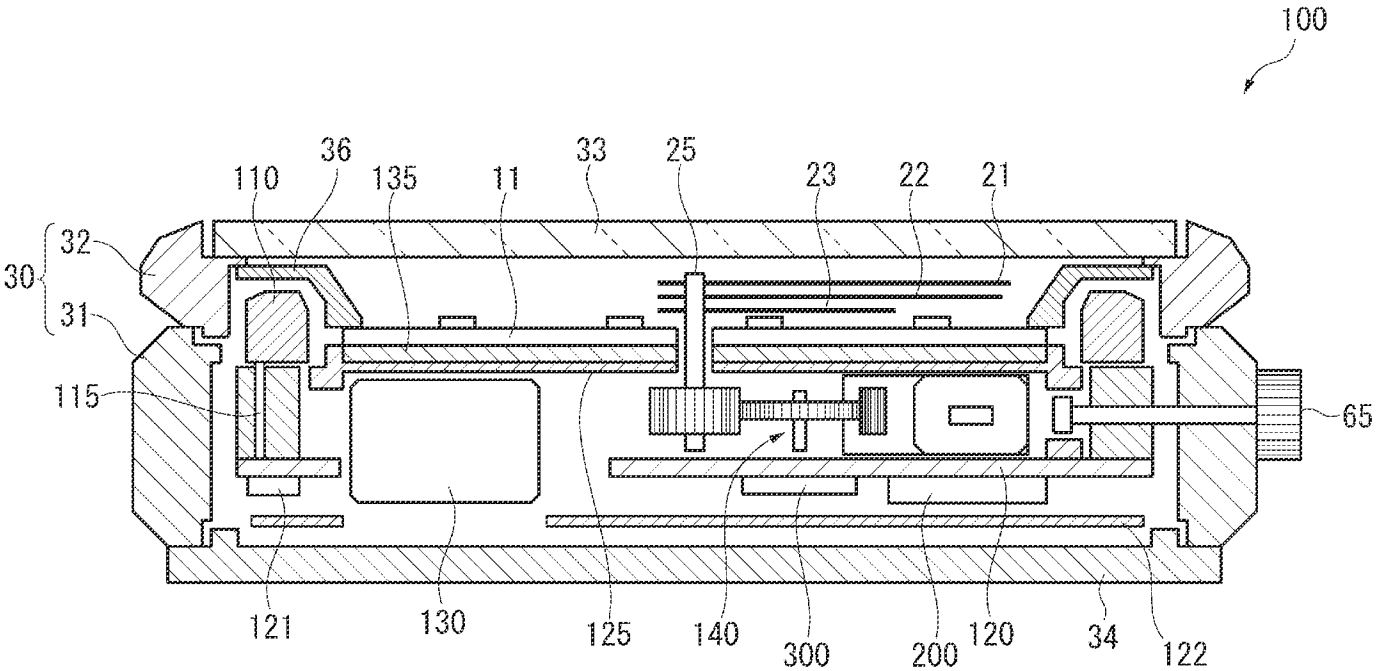
FIG. 3 is a vertical section view of the electronic device.

FIG. 2 is a plan view of the electronic device 100 from the face side, and FIG. 3 is a section view of part of the electronic device 100. The electronic device 100 according to this embodiment includes a chronograph.

As shown in FIG. 2 and FIG. 3, the electronic device 100 has an outside case 30, a crystal 33, and a back cover 34.

The outside case 30 has a ceramic bezel 32 fit to a tubular case member 31 made of metal. A disc-shaped dial 11 used as the time display part is held by a plastic annular dial ring 36 on the inside circumference side of the ceramic bezel 32.

Hands 21, 22, 23 are disposed above the dial 11. Around the center of the dial 11 are further disposed a round first subdial 70 and hand 71 at 2:00; a round second subdial 80 and hand 81 at 10:00; a round third subdial 90 and hand 91 at 6:00; and a rectangular calendar window 15 at 4:00. The dial 11, hands 21, 22, 23, first subdial 70, second subdial 80, third subdial 90, and calendar window 15 can be seen through the crystal 33.

A calendar wheel 16 is disposed behind the dial 11, and the calendar wheel 16 is visible through the button 15.

A button A 61 is disposed to the side of the outside case 30 at 8:00 from the center of the dial 11; a button B 62 is disposed at 10:00; a button C 63 is disposed at 2:00; a button D 64 is disposed at 4:00; and a crown 65 is disposed at 3:00. When the button A 61, button B 62, button C 63, button D 64, and crown 50 are operated, operating signals corresponding to the specific operation are output.

As shown in FIG. 3, of the two main openings in the metal outside case 30, the opening on the face side of the electronic device 100 is covered by the crystal 33 through the intervening ceramic bezel 32, and the opening on the back side is covered by the metal back cover 34.

Disposed inside the outside case 30 are the dial ring 36 attached to the inside circumference of the bezel 32; an optically transparent dial 11; a center arbor 25 that passes through the dial 11; the hands 21, 22, 23 that rotate on the center arbor 25; and a drive mechanism 140 that drives the hands 71, 81, 91 and the calendar wheel 16 not shown in FIG. 3.

The center arbor 25 passes through the center of the outside case 30 in plan view, and is disposed on the center axis in the direction between the face and back of the timepiece.

The dial ring 36 has a flat portion of which the outside edge contacts the inside circumference surface of the ceramic bezel 32 and one surface is parallel to the crystal 33; and a beveled portion that slopes toward the dial 11 so that the inside edge contacts the dial 11. The dial ring 36 is ring-shaped when seen in plan view, and conically shaped when seen in section view. A donut-shaped storage space is formed by the flat portion and the beveled portion of the dial ring 36, and the inside circumference surface of the ceramic bezel 32. A ring-shaped GPS antenna 110 is housed in this storage space.

The GPS antenna 110 has a ring-shaped dielectric base on which a metal antenna pattern is formed by a plating or silver paste printing process. The GPS antenna 110 is disposed around the perimeter of the dial 11 and the inside circumference side of the ceramic bezel 32, is covered by the plastic dial ring 36 and crystal 33, and can therefore assure good reception. The dielectric in this embodiment is molded from a titanium oxide or other high frequency dielectric material mixed with resin, and enables rendering a small antenna by using the wavelength-shortening effect of the dielectric.

The dial 11 is a round disc for indicating the time inside the outside case 30, is made from plastic or other optically transmissive material, and is disposed inside the dial ring 36 with the hands 21, 22, 23 between the dial 11 and the crystal 33.

A photovoltaic solar cell 135 is disposed between the dial 11 and the ground plate 125 to which the drive mechanism 140 is attached. The solar cell 135 converts light energy to electrical energy (power). The solar cell 135 also has a sunlight detection function. Holes through which the center arbor 25, arbors (not shown in the figure) for the hand 71 of the first subdial 70, the hand 81 of the second subdial 80, and the hand 91 of the third subdial 90 pass, and the aperture of the calendar window 15, are formed in the dial 11, the solar cell 135, and the ground plate 125.

The drive mechanism 140 is attached to the ground plate 125, and is covered on the back side by a circuit board 120. The drive mechanism 140 has a stepper motor and a wheel train of wheels, and drives the hands by the stepper motor turning the center arbor 25 through the wheel train.

The drive mechanism 140 more specifically includes first to sixth drive mechanisms. The first drive mechanism drives the hand 22 (minute hand) and the hand 23 (hour hand) that indicate the minute and hour of the internal clock (the current time). Similar drive mechanisms (not shown in the figure) drive the chronograph seconds hand 21, the hand 71 of the first subdial 70, the hand 81 of the second subdial 80, and the hand 91 of the third subdial 90. More specifically, the second drive mechanism drives the seconds hand 21 of the chronograph function; the third drive mechanism drives the minute hand 71 of the chronograph function; the fourth drive mechanism drives the hand (seconds hand) 81 indicating the second of the current time; the fifth drive mechanism drives the hour hand 91 of the chronograph function; and the sixth drive mechanism drives the calendar wheel 16 that is visible through the calendar window 15.

The circuit board 120 includes a GPS receiver circuit 121, control circuit 200, and storage unit 300. The circuit board 120 and GPS antenna 110 are connected through an antenna connection pin 115. A circuit cover 122 is disposed on the back cover 34 side of the circuit board 120 carrying the GPS receiver circuit 121, control circuit 200 and storage unit 300, and covers these components. A lithium ion battery or other type of storage battery 130 is disposed between the ground plate 125 and the back cover 34. The storage battery 130 is charged by power produced by the solar cell 135.

The GPS antenna 110 is powered through a power supply node, and the antenna connection pin 115 disposed on the back side of the GPS antenna 110 is connected to this power supply node. The antenna connection pin 115 is a metal pin-shaped connector that is disposed to the circuit board 120 and passes through a through-hole formed in the ground plate 125 into the storage space. The circuit board 120 and the GPS antenna 110 inside the storage space are connected to the antenna connection pin 115.

Electronic Device Display Function

As shown in FIG. 2, a scale dividing the outside circumference into 60 divisions, each of which is subdivided into a ⅕ scale of 5 divisions, is marked around the outside perimeter of the dial 11. Using this scale, the second hand 21 indicates the seconds of the chronograph function, the minute hand 22 indicates the minute of the internal clock, and the hour hand 23 indicates the hour of the internal clock. The chronograph function can be used by operating button C 63 and button D 64.

A scale of 60 divisions with numeric markers 10 to 60 at increments of 10 are disposed around the outside of the round first subdial 70 on the dial 11. The hand 71 of this first subdial 70 uses this scale to indicate the minute of the chronograph function.

A scale of 60 divisions with numeric markers 0 to 11 is disposed around the outside of the round second subdial 80 on the dial 11. The hand 81 of this second subdial 80 uses this scale to indicate the second of the internal clock.

The letter Y is disposed to the 52-second position and the letter N is disposed to the 38-second position of the second subdial 80. These letters are used to indicate the result of acquiring information based on the satellite signals received from the satellites (Y=reception (acquisition) successful, N=reception (acquisition) failed). When reception result display mode is entered by the user operating button B 62, the hand 81 jumps to either Y or N to indicate the result of satellite signal reception. The automatic reception mode can be turned ON/OFF by the operator operating button A 61 and button B 62.

Indication of Y or N expresses whether or not (Y=operating; N=stopped) the first reception control unit, which executes the light-activated automatic reception process described below, is operating. When the reception control unit switching mode is entered by the user simultaneously pressing the button A 61 and button B 62, the hand 81 points to either Y or N and indicates whether or not the first reception control unit 210 is operating. The user can also operate the button A 61 to set whether or not the first reception control unit 210 operates. When button B 62 is operated, the switching mode of the reception control unit is cancelled and the normal operating mode is resumed.

The markers around the round third subdial 90 on the dial 11 are described next. Note that the expression "n:00 position" (where n is a desirable natural number) used in the following description of the third subdial 90 denotes the direction (position) from the center of the third subdial 90 to a position on the outside of the dial.

A scale of six divisions with numeric markers 0 to 5 is formed on the outside perimeter of the third subdial 90 from 12:00 to 6:00. Using this scale, the hand 91 indicates the hour of the chronograph function.

The chronograph function in this embodiment can count time to 5 hours 59 minutes 59 seconds using hands 21, 71, 91.

The letters DST and an open circle (O) are disposed to the third subdial 90 in the area from 6:00 to 7:00. DST denotes Daylight Savings Time (also known as summer time). These markers are used to indicate if daylight savings time is being used (DST=daylight savings time is in use; O indicates daylight savings time is not in use). The user can set the DST mode of the electronic device 100 on or off by operating the crown 65 and button B 62 to appropriately set the hand 91 to DST or O.

A sickle-shaped marker 92 that is wide at the base at 9:00 and narrows to the end at 7:00 is disposed along the outside edge of the third subdial 90 from 7:00 to 9:00. This marker 92 is a power indicator for the storage battery 130 (FIG. 3), and the hand 91 indicates a position at the base, middle, or tip of the marker 92 according to the reserve power in the storage battery 130.

An airplane-shaped marker 93 is disposed in the area from 9:00 to 10:00 on the outside of the third subdial 90. This airplane marker 93 denotes an in-flight mode. Satellite signal reception is prohibited in some countries by aviation regulations during take-off and landing of an airplane. Satellite signal reception by the electronic device 100 can be stopped by the user operating the button A 61 and setting the hand 91 to the airplane marker 93 (in-flight mode).

Numeric markers 1 and 4+ are disposed in the area from 10:00 to 12:00 on the outside of the third subdial 90. These numbers and marker are used to indicate the satellite signal reception mode. The 1 marker means that the GPS time information is received and the internal time corrected, and the 4+ marker means that GPS time information and orbit information are received, and the internal time and time zone described below were corrected.

The user can set the reception mode by operating button A 61. More specifically, the time information reception mode (timekeeping mode) is set by selecting the 1 with the hand 91. The positioning information reception mode (positioning mode) is set by selecting the 4+ marker with the hand 91.

When the operator operates the button B 62 and selects the information acquisition mode, the hand 91 jumps to the 1 or the 4+ marker to indicate the reception mode of the satellite signal that was just received by the electronic device 100.

The calendar window 15 is a rectangular opening formed in the dial 11, and a number printed on the calendar wheel 16 can be seen through the calendar window 15. This number indicates the day value of the current date.

The relationship between Coordinated Universal Time (UTC), the time difference, standard time, and the time zone is described next.

A time zone denotes a geographical area that uses a common standard time, and there are currently 40 time zones around the world. Each time zone is distinguished by the time difference between the standard time used in the time zone and UTC. Japan, for example, belongs in a time zone using a standard time that is 9 hours ahead of UTC, or UTC+9. The standard time used in each time zone can be obtained from UTC and the time difference to UTC.

As described above, a scale divided into 60 minutes and seconds is formed on the dial 11, and time difference information 37 representing the time difference to Coordinated Universal Time (UTC) is indicated by numbers and non-numeric markers along the time scale on the dial ring 36 surrounding the circumference of the dial 11. The numeric time difference information 37 denotes the integer value of the time difference, and the non-numeric time difference information 37 denotes a time difference that is not a whole number. The time difference between UTC and the internal time indicated by hands 22, 23, 81 can be checked by the time difference information 37 indicated by the second hand 21 by operating the crown 65.

City markers 35 each representing the name of a major city in the time zone using the standard time corresponding to the time difference of the time difference information 37 denoted on the dial ring 36 is displayed beside the time difference information 37 on the bezel 32 around the dial ring 36. Indications based on the time difference information 45 and the city markers 35 are referred to below as the time zone indications 38. The same number of time zone indications 38 as time zones that are used around the world are shown in this embodiment of the invention.

Circuit Design of an Electronic Device

Figure 4:
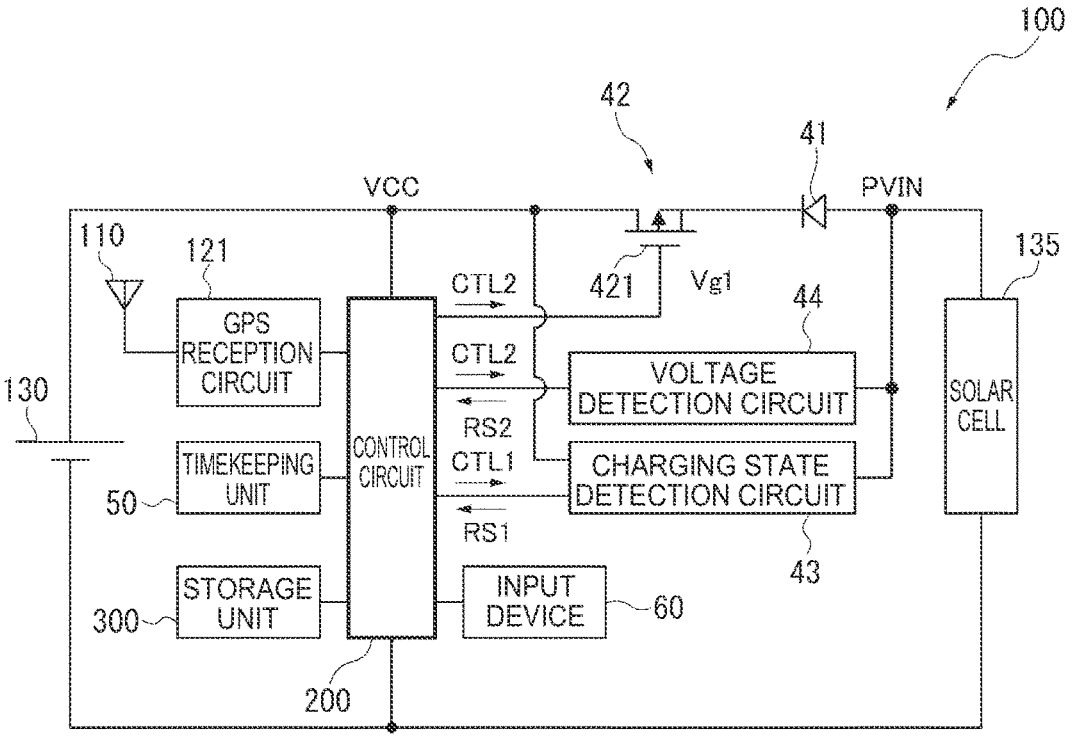
FIG. 4 is a block diagram showing the circuit design of the electronic device.
Figure 5:
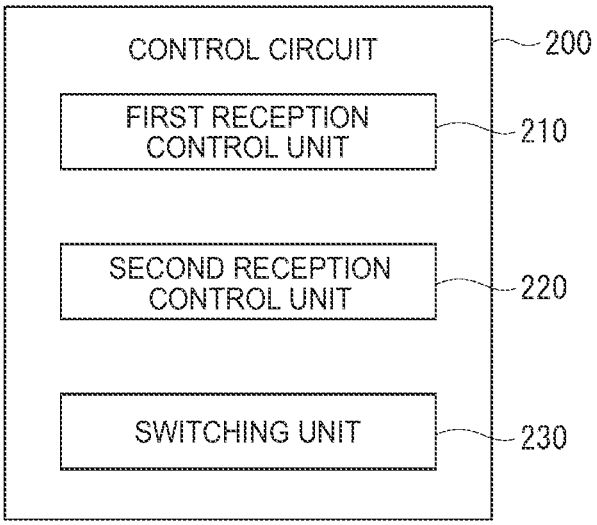
FIG. 5 is a block diagram showing the configuration of the control circuit.

FIG. 4 is a block diagram showing the circuit configuration of the electronic device 100. As shown in this figure, the electronic device 100 has a solar cell 135, storage battery 130, GPS receiver circuit 121, control circuit 200, diode 41, charging control switch 42, charging state detection circuit 43, voltage detection circuit 44, timekeeping unit 50, storage unit 300, and input device 60, embodying the radio signal receiver according to the invention. Note that an illuminance detection circuit used as an environment detection circuit of the invention includes the charging state detection circuit 43 and voltage detection circuit 44.

The GPS receiver circuit 121 is a load that is driven by power stored in the storage battery 130, attempts to receive satellite signals from the GPS satellites 8 through the GPS antenna 110 each time the GPS receiver circuit 121 is driven, supplies the acquired orbit information, GPS time information, and other information to the control circuit 200 when reception succeeds, and sends a failure report to the control circuit 200 when reception fails. Note that the configuration of the GPS receiver circuit 121 is the same as the configuration of a GPS receiver circuit known from the literature, and description thereof is omitted.

Diode 41 is disposed to a path that electrically connects the solar cell 135 and storage battery 130, and blocks current from the storage battery 130 to the solar cell 135 (reverse current) without blocking current from the solar cell 135 to the storage battery 130 (forward current). Note that forward current flow is limited to when the solar cell 135 voltage is greater than the storage battery 130 voltage, that is, while charging. A field-effect transistor (FET) may also be used instead of a diode 41.

The charging control switch 42 closes and opens the current path from the solar cell 135 to the storage battery 130, and includes a switching device 421 disposed to a path that electrically connects the solar cell 135 and storage battery 130. The charging control switch 42 turns on (closes) when the switching device 421 switches from the off state to the on state, and turns off (opens) when the switching device 421 switches from the on state to the off state.

For example, the charging control switch 42 turns off to prevent the battery voltage of the storage battery 130 from going above a specific level so that battery characteristics do not deteriorate as a result of overcharging.

The switching device 421 is a p-channel transistor that turns on when the gate voltage Vg1 is LOW and turns off when HIGH. The gate voltage Vg1 is controlled by the control circuit 200.

The charging state detection circuit 43 operates based on a binary control signal CTL1 that specifies the charging state detection timing, detects the state of charging from the solar cell 135 to the storage battery 130 (the charging state), and outputs detection result RS1 to the control circuit 200. The charging state is either "charging" or "not charging", and charging state detection is based on the battery voltage VCC and PVIN from the solar cell 135 when the charging control switch 42 is ON. For example, if the voltage drop of the diode 41 is Vth and the ON resistance of the switching device 421 is ignored, "charging" can be determined when PVIN-Vth>VCC, and "not charging" can be determined when PVIN-Vth≤VCC.

In this embodiment of the invention the control signal CTL1 is a pulse signal with a 1-second period, and the charging state detection circuit 43 detects the charging state when the control signal CTL1 is HIGH. More specifically, the charging state detection circuit 43 repeatedly detects the charging state on a 1-second period while the charging control switch 42 remains closed.

Note that the charging state is detected intermittently to reduce the power consumption of the charging state detection circuit 43. If this reduction is not necessary, the charging state may be detected continuously. The charging state detection circuit 43 can be configured using a comparator or A/D converter, for example.

The voltage detection circuit 44 operates based on a binary control signal CTL2 that specifies the voltage detection timing, and detects the terminal voltage PVIN of the solar cell 135, that is, the open circuit voltage of the solar cell 135, when the charging control switch 42 is turned off by the control signal CTL2. The voltage detection circuit 44 outputs the detection result RS2 of the open circuit voltage to the control circuit 200.

The timekeeping unit 50 includes the drive mechanism 140 and hands, is driven by power stored in the storage battery 130, and runs a timekeeping process. This timekeeping process both keeps the time and displays the time corresponding to the kept time (the display time) on the face of the electronic device 100.

The storage unit 300 stores various information. The storage capacity of the storage unit 300 can be determined according to the number of types of information and the amount of information stored.

The input device 60 includes button A 61 to button D 64, and the crown 65, and outputs the position of the crown 65 and operating signals responding to operation of the buttons to the control circuit 200.

Control Circuit Configuration

The control circuit 200 is embodied by a CPU for controlling the electronic device 100. The control circuit 200 controls the GPS receiver circuit 121 and executes the reception process. The control circuit 200 also controls operation of the charging state detection circuit 43 and the voltage detection circuit 44.

More specifically, the control circuit 200 includes a first reception control unit 210, a second reception control unit 220, and a switching unit 230.

Based on the detection result of the environment detection circuit embodied by the charging state detection circuit 43 and voltage detection circuit 44, the first reception control unit 210 operates the GPS receiver circuit 121 and executes the reception process (light-activated automatic reception process) when the electronic device 100 is determined to be in an environment suited to receiving satellite signals, such as outdoors. If the electronic device 100 is determined to not be in an environment suited to receiving satellite signals for a previously set specific time or more, the first reception control unit 210 operates the GPS receiver circuit 121 at the preset scheduled reception time to execute the reception process (scheduled reception). The operation of the first reception control unit 210 is described further below in detail.

The second reception control unit 220 operates the GPS receiver circuit 121 once a day at the scheduled reception time stored in the storage unit 300 to execute the reception process (scheduled reception process).

The switching unit 230 operates when the input device 60 is operated to set the switching mode of the reception control unit, and switches between the first reception control unit 210 and second reception control unit 220 according to the input from the input device 60. In other words, the switching unit 230 selectively operates either the first reception control unit 210 or the second reception control unit 220.

More specifically, when the button A 61 and button B 62 of the input device 60 are simultaneously depressed for 3 seconds or more, the reception control unit switching mode is entered. When the button A 61 is then operated, the switching unit 230 stops whichever of the first reception control unit 210 and second reception control unit 220 is operating and starts the other.

Switching Unit Operation

Figure 6:
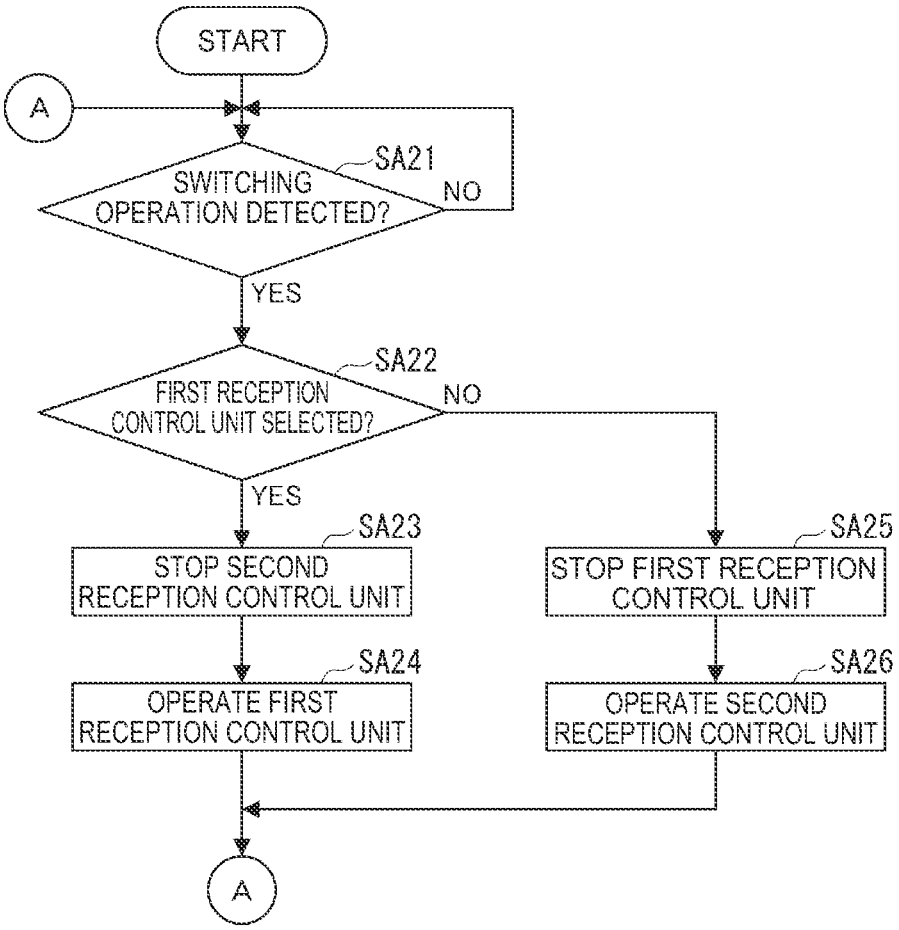
FIG. 6 is a flow chart describing the switching process of the switching unit in the first embodiment of the invention.

FIG. 6 is a flow chart of the switching process of the switching unit 230.

This switching process is stared when the input device 60 is operated to enter the switching mode of the reception control unit.

As shown in FIG. 6, when the switching process starts, the switching unit 230 determines based on the operating signal output from the input device 60 whether or not there was an input operation to change the reception control unit (step SA21). If SA21 returns No, the switching unit 230 repeats step SA21.

If SA21 returns Yes, the switching unit 230 determines from the input operation if the first reception control unit 210 was selected (step SA22). For example, based on information indicating which of the first reception control unit 210 and second reception control unit 220 was operating before the input operation, and the number of times button A 61 was operated, the switching unit 230 determines whether the first reception control unit 210 or the second reception control unit 220 was selected.

If SA22 returns Yes, the second reception control unit 220 is operating and the switching unit 230 therefore first stops operation of the second reception control unit 220 (step SA23). The switching unit 230 then starts operating the first reception control unit 210 (step SA24). Control then returns to SA21.

However, if SA22 returns No, the first reception control unit 210 is operating and the switching unit 230 therefore first stops operation of the first reception control unit 210 (step SA25). The switching unit 230 then starts operating the second reception control unit 220 (step SA26). Control then returns to SA21.

Operation of the First Reception Control Unit

Figure 7:
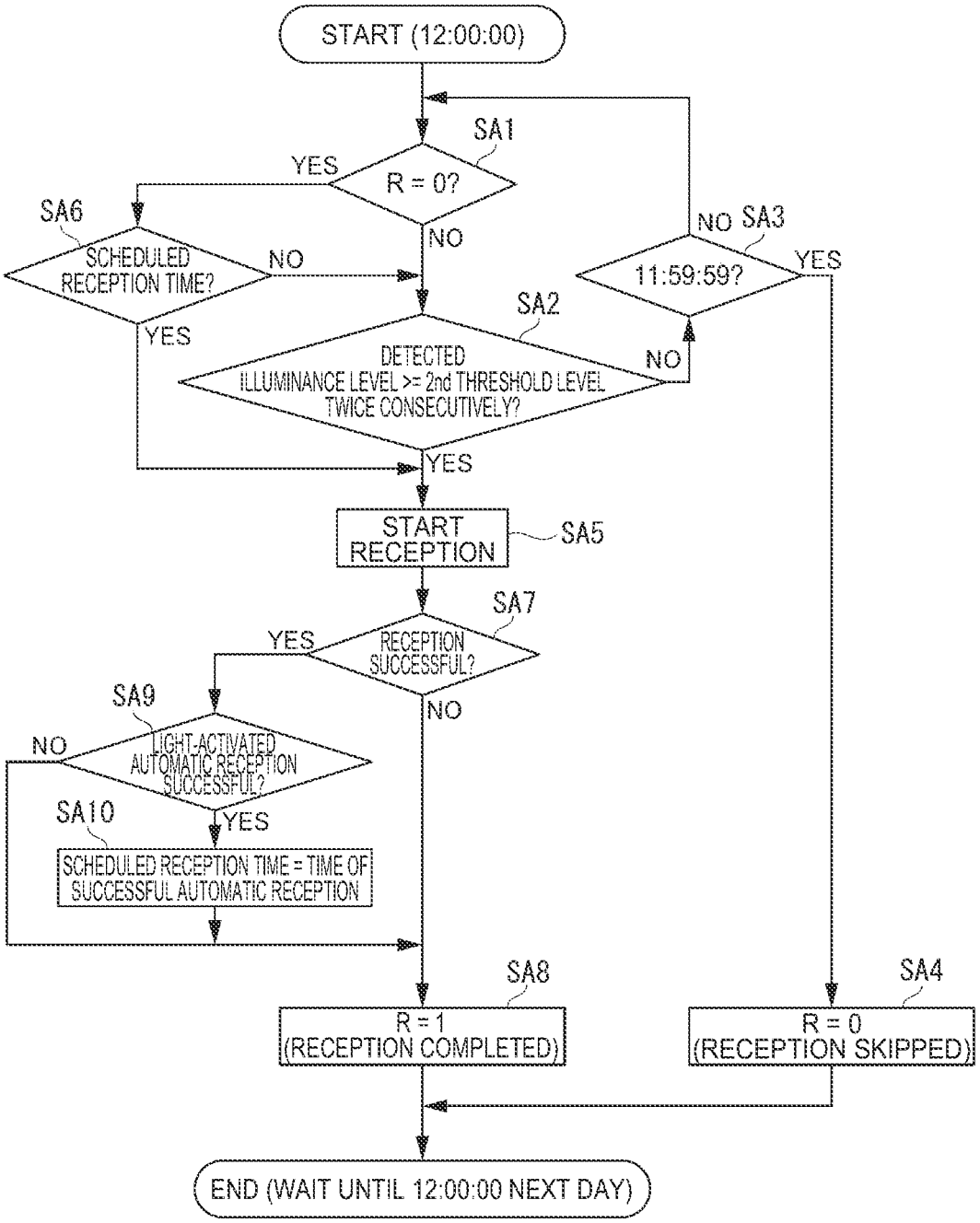
FIG. 7 is a flow chart describing the satellite signal reception process of the first reception control unit in the first embodiment of the invention.
Figure 8:
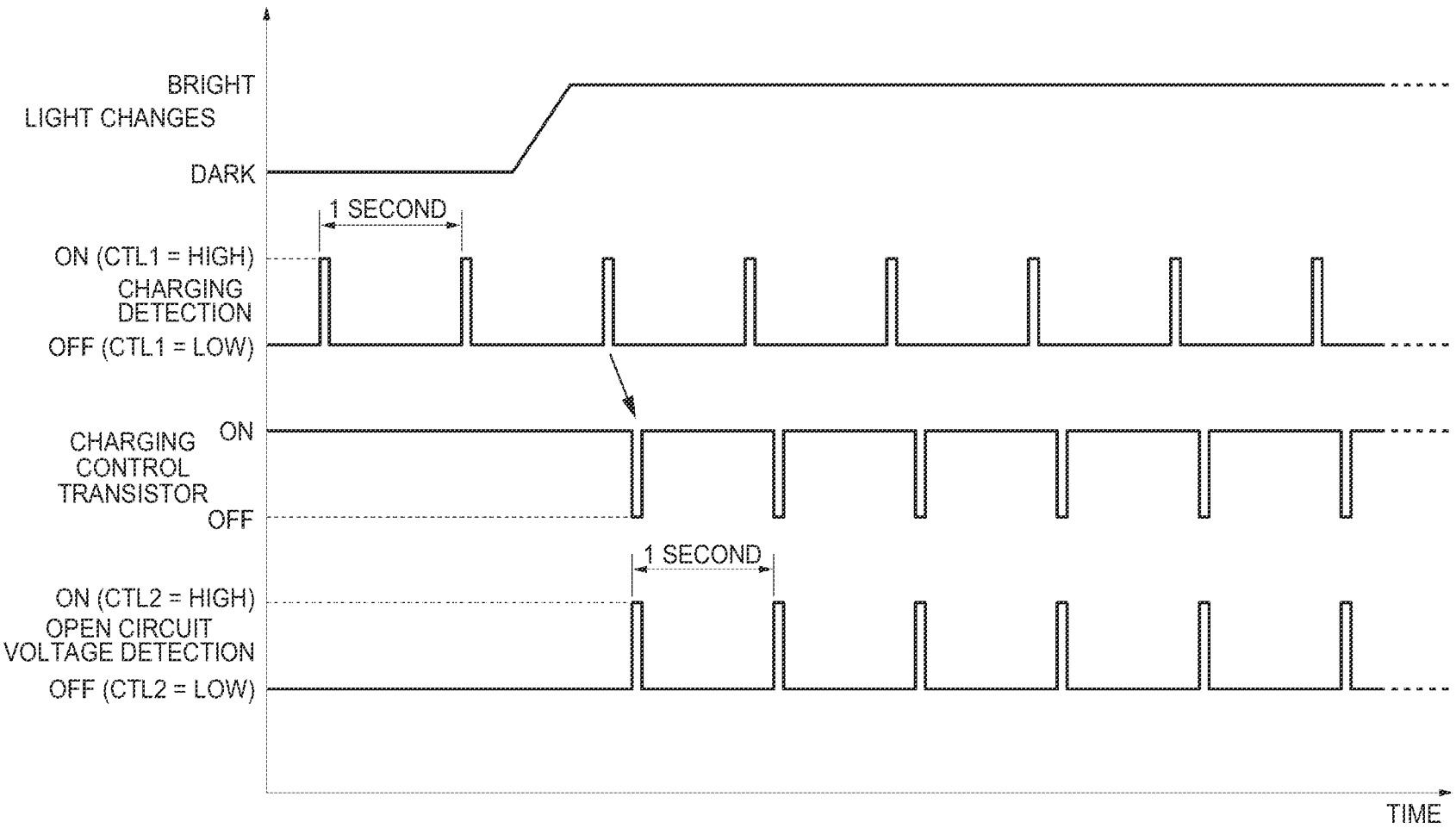
FIG. 8 describes the timing of the charging state detection and open circuit voltage detection operation.
Figure 9:
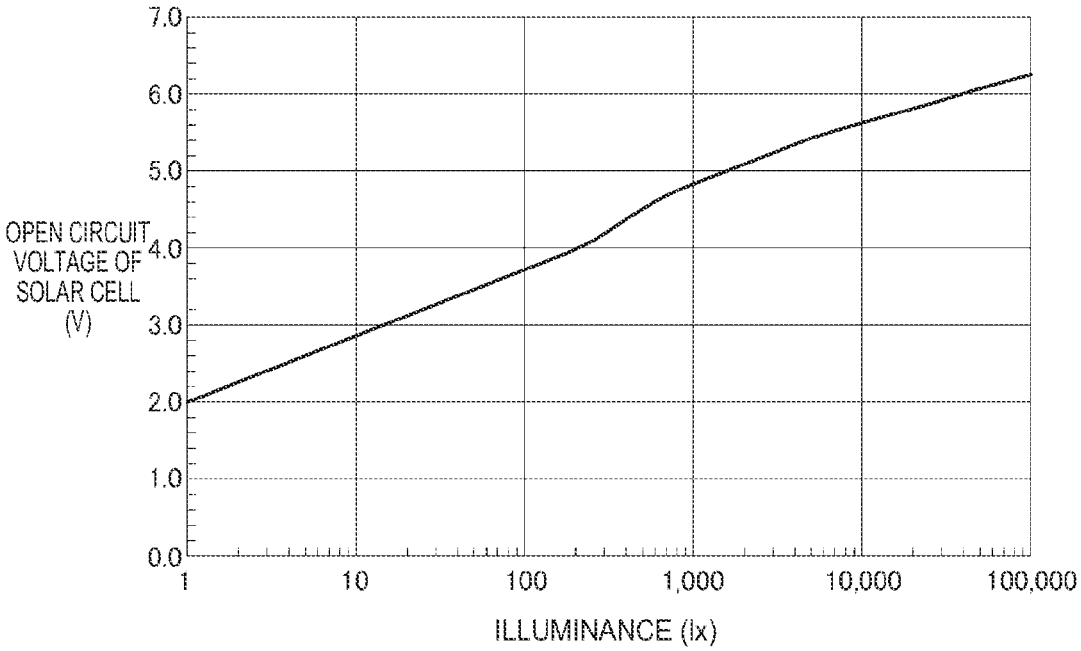
FIG. 9 is a graph showing the relationship between the illuminance of light incident to the solar cell of the electronic device, and the open circuit voltage of the solar cell.

FIG. 7 is a flow chart of the satellite signal reception process of the first reception control unit in the first embodiment of the invention. FIG. 8 is a timing chart of charging state detection, open circuit voltage detection, and the reception process. FIG. 9 is a graph showing the relationship between the illuminance of light incident to the solar cell of the electronic device, and the open circuit voltage of the solar cell. FIG. 10 shows the relationship between the open circuit voltage of the solar cell and the illuminance of light incident to the solar cell at different detected illuminance levels.

The operation of the first reception control unit 210 in this electronic device 100 is described below based on the flow chart in FIG. 7.

When selected by the switching unit 230, the first reception control unit 210 starts the control process at 12:00:00 daily. The first reception control unit 210 first determines if a variable R=0 (SA1). This variable R is set to 1 if the satellite signal reception process was performed any time within a specific period of time, which is 24 hours in this embodiment of the invention, regardless of whether or not reception was successful. However, if the reception process was not performed even once in this 24-hour period, that is, if the location of the electronic device 100 is determined to be in an environment unsuited to receiving satellite signals and this state continues for 24 hours or more, the variable R is set to 0. Note that this specific time is not limited to 24 hours and can be set to any desired time, but is usually preferably set to a time of half a day or longer, such as a half day (12 hours), 1 day (24 hours), or 2 days (48 hours).

If SA1 returns No (variable R=1, the reception process ran during the specific period of time), the first reception control unit 210 determines if the detected illuminance level of the open circuit voltage corresponding to the illuminance of light incident to the solar cell 135 is greater than or equal to a second threshold level, which is the threshold value, twice consecutively (SA2). More specifically, if the reception process ran within the specific period of time, the first reception control unit 210 starts the satellite signal reception process based on the illuminance of light incident to the solar cell 135 (light-activated automatic reception process) as described in further detail below.

More specifically, as shown in FIG. 8, the first reception control unit 210 outputs the control signal CTL1 at a 1-second interval and drives the charging state detection circuit 43 on a regular cycle. When the control signal CTL1 is input, the charging state detection circuit 43 outputs detection result RS1 indicating if charging is in progress to the first reception control unit 210. The first reception control unit 210 thus determines if charging is in progress or not. Note that as described below the charging control switch 42 turns off only at the time the voltage detection circuit 44 operates. Note that the charging state is detected at a 1-second interval in this example, but the invention is not limited to this interval, and a period of 0.5 s, 10 s, or 1 minute may be used, for example.

When the electronic device 100 is exposed to low level light and the solar cell 135 is not producing power, the charging state detection circuit 43 outputs a not-charging detection result RS1 to the first reception control unit 210. In this case the first reception control unit 210 determines that charging is not in progress (SA2 returns No), and the first reception control unit 210 outputs the control signal CTL2 LOW.

Therefore, when it is determined that charging is not in progress, the first reception control unit 210 can determine that the likelihood is high that the electronic device 100 is not in a place suited to GPS signal reception, such as outdoors.

If the first reception control unit 210 determines that the battery is being charged, it operates the voltage detection circuit 44. In this case, as described above, the first reception control unit 210 turns the charging control switch 42 off. More specifically, when the charging state detection circuit 43 detects that charging is in progress, the first reception control unit 210 outputs the control signal CTL2 at a 1-second interval and operates the voltage detection circuit 44. Because the charging control switch 42 is turned off by the control signal CTL2 from the first reception control unit 210, the solar cell 135 and voltage detection circuit 44 are cut off from the storage battery 130. As a result, the voltage detection circuit 44 can detect the open circuit voltage corresponding to the illuminance of light incident to the solar cell 135 without being affected by the charge voltage of the storage battery 130.

Note that when the charging control switch 42 is off, the charging state cannot be detected by the charging state detection circuit 43. As a result, the first reception control unit 210 shifts the output timing of the control signal CTL1 and control signal CTL2 so that the output timing of the control signal CTL1 to the charging state detection circuit 43, and the output timing of the control signal CTL2 to the voltage detection circuit 44, do not match.

As shown in FIG. 9, in this embodiment of the invention the open circuit voltage detected by the voltage detection circuit 44 increases as the illuminance of light incident to the solar cell 135 increases.

Note that a configuration that detects the illuminance of light on the solar cell 135 by detecting the short-circuit current of the solar cell 135 instead of the open circuit voltage of the solar cell 135 may be used as the voltage detection circuit 44.

The first reception control unit 210 determines the detected illuminance level corresponding to the open circuit voltage from the detection result RS2 output from the voltage detection circuit 44. In this embodiment of the invention the first reception control unit 210 determines the detected illuminance level based on the relationship shown in FIG. 10. Note that the open circuit voltage and illuminance values shown in FIG. 10 represent the lower limit of each detected illuminance level. For example, when the open circuit voltage is greater than or equal to 5.6 V and less than 5.8 V, the first reception control unit 210 determines the detected illuminance level is 7, and when the open circuit voltage is greater than or equal to 5.9 V and less than 6.2 V, determines the detected illuminance level is 9.

The first reception control unit 210 thus determines in step SA2 if the detected illuminance level acquired from the detection result RS2 is greater than or equal to the second threshold level, which is preset as a second threshold value, twice consecutively based on voltage detection at a 1-second interval.

The relationship between the detected illuminance level and the open circuit voltage of the solar cell is preset based on the relationship shown in FIG. 10. That is, the threshold value for determining if the detected illuminance level of the light incident to the solar cell 135 is a high illuminance level that is greater than or equal to a preset second threshold level, or is a low illuminance level below the second threshold level, is set as shown in this figure. However, the relationship between the detected illuminance level and the open circuit voltage of the solar cell is not limited to the relationship shown in FIG. 10, and can be set desirably.

The illuminance of the light incident to the solar cell 135 under fluorescent lights is normally 500 to 1000 lux while the illuminance of the light when the solar cell 135 is exposed to daylight on a cloudy day is normally about 5000 lux. As a result, detected illuminance level 5 corresponding to light of 5000 lux incident to the solar cell 135 is set as the second threshold level.

The second threshold level may also be set to a level other than 5. In addition, when the detected illuminance level remains less than the second threshold level continuously for a specific time or more, the second threshold level could be reset to one level lower to loosen the conditions for operating the GPS reception circuit 121. By thus resetting the second threshold level lower, the detected illuminance level more easily goes to the second threshold level or above, and opportunities to operate the GPS reception circuit 121 can be created.

When the solar cell 135 deteriorates and its power conversion efficiency drops, the open circuit voltage becomes even lower even when the solar cell 135 is exposed to light of the same illuminance, and the detected illuminance level evaluated by the first reception control unit 210 also drops. If the second threshold level remains constant in such cases, the first reception control unit 210 will be unable to appropriately determine if the electronic device 100 is outdoors or in another location suited to receiving GPS signals, and problems result.

As described above, if the second threshold level is lowered, an opportunity to operate the GPS reception circuit 121 can be created even if the detected illuminance level only goes to less than or equal to 4, which is lower than the 5 set here as the second threshold level, when exposed to light of 5000 lux because deterioration of the solar cell 135 has advanced.

If SA2 returns No (the light level is low), the first reception control unit 210 can determine that the likelihood is high that the electronic device 100 is not outdoors and is not in a location suited to GPS reception.

More specifically, if the electronic device 100 is in an environment suited to GPS reception, such as outdoors, and it is during the day, light exceeding the second threshold level should be continuously incident to the solar cell 135 for more than 1 second. Therefore, if the open circuit voltage is detected at a 1-second interval and an open circuit voltage exceeding the second threshold level is detected twice consecutively, the likelihood is high that the electronic device 100 is in an environment suited to GPS reception, such as outdoors.

However, if open circuit voltage exceeding the second threshold level cannot be detected twice consecutively, the open circuit voltage may not go to the second threshold level even once because the person wearing the wristwatch that is the electronic device 100 is moving around indoors, or may not go to the second threshold level twice consecutively because direct sunlight hit the solar cell 135 momentarily through an office window, for example. Receiving GPS signals with good sensitivity is difficult under such circumstances.

This embodiment of the invention therefore determines in SA2 if the detected illuminance level is greater than or equal to the second threshold level twice consecutively. Note that this decision is not limited to determining if the detected illuminance level is greater than or equal to the second threshold level twice consecutively. For example, if determining whether the user is in an environment suited to GPS reception, such as outdoors, more accurately is desired, the determining criteria could be whether the detected illuminance level is greater than or equal to the second threshold level three times consecutively.

When SA2 returns No, whether the current time is before 11:59:59 on the day after the day that the first reception control unit 210 started control is determined (SA3). This enables the first reception control unit 210 to determine if the preset specific time has passed without executing the reception process. This specific time in this example is 24 hours. If SA3 returns No, control returns to SA1, and the charging state detection circuit 43 operates on a regular cycle.

However, if SA3 returns Yes (the specific time has passed), variable R is set to 0 (SA4), the process ends, and a standby mode is entered until the restart control time at which the first reception control unit 210 next starts the process. The restart control time in this example is 1 second later at 12:00:00.

If SA2 returns Yes, conditions can be considered suitable for receiving GPS signals as described above, and the first reception control unit 210 therefore operates the GPS reception circuit 121 and starts receiving GPS satellite signals (SA5).

The reception process started in SA5 after SA2 returns Yes is the light-activated automatic reception process or a scheduled reception process. Note that the light-activated automatic reception process and the scheduled reception process are collectively referred to below as simply "automatic reception." The reception process is executed in the timekeeping mode in this automatic reception process. The reception process takes longer in the positioning mode because signals must be received from three or more GPS satellites 8 in order to determine the position. As a result, the electronic device 100 is preferably kept in an environment suited to GPS reception, such as outdoors, until signal reception ends, but the user may not realize that reception is in progress in the automatic reception process and move indoors during reception. As a result, reception in the positioning mode is preferably done only when the user intentionally starts reception, that is, only in a manual reception process.

In the timekeeping mode, however, time information can be acquired by receiving signals from one GPS satellite 8, and the length of the reception process can be shortened. The reception process can therefore be executed even when not specifically intended by the user, and the timekeeping mode is suited to an automatic reception process.

If SA1 returns Yes (variable R=0, and the reception process was not performed in the specific time), the first reception control unit 210 determines if the current time is the preset scheduled reception time (SA6). As described in detail below, the scheduled reception time is the time reception started when the light-activated automatic reception process was successful (the "reception start time" below), and is stored in storage unit 300.

Note that the scheduled reception time could be the time that reception ended (the "reception end time").

In addition, if the system was reset and the scheduled reception time is not stored in the storage unit 300, step SA6 may be executed using a default time as the scheduled reception time, or it may be decided to skip the scheduled reception process (SA6 returns No).

If SA6 returns No, the first reception control unit 210 goes to SA2. If SA6 returns Yes, the first reception control unit 210 goes to SA5.

More specifically, if the reception process was not performed within the specific time, and the current time is not the scheduled reception time, the first reception control unit 210 determines if the light-activated automatic reception process can be performed. If the current time then reaches the scheduled reception time, the first reception control unit 210 unconditionally executes the satellite signal reception process at the scheduled time regardless of the intensity of light incident to the solar cell 135.

The first reception control unit 210 then determines if the reception process started in SA5 succeeded in receiving a GPS signal (SA7).

Note that the GPS reception circuit 121 first looks for a GPS satellite 8, and the GPS reception circuit 121 detects a GPS signal. If a GPS signal was detected, receiving the GPS signal continues to receive the time information. If the time information can be received, receiving a GPS signal by the reception process is determined successful. Otherwise, that is, if the GPS reception circuit 121 could not detect a GPS signal, or the time information could not be received, the reception process is determined to have failed in receiving a GPS signal.

In addition, if the reception process is determined to have failed in receiving a GPS signal (SA7 returns No), the first reception control unit 210 sets the variable R to 1, ends the process (SA8), and enters a standby mode until 12:00:00 the next day, which is the restart control time.

Note that if SA7 returns No, the second threshold level may be reset to one level higher. Setting the second threshold level one level higher makes it more difficult for the detection level to go the second threshold level or above when the process resumes from SA1 at 12:00:00 the next day. More specifically, when an electronic device 100 located indoors is exposed to extremely intense light and the reception process is executed because the detection level is greater than or equal to the second threshold level, the second threshold level is increased one level at a time because reception fails. By thus increasing the second threshold level one level at a time, the detection level will eventually not rise to the second threshold level under the indoor lighting, and will only go to the second threshold level or above when outdoors exposed to direct sunlight. The second threshold level can thus be optimized to the daily pattern of the person using the electronic device 100. By thus making the condition for operating the GPS reception circuit 121 stricter when the GPS reception circuit 121 fails at receiving the GPS signal, the GPS reception circuit 121 can be operated in an environment that is suited to receiving GPS signals.

When the reception process is determined to have succeeded at receiving the GPS signal (SA7 returns Yes), the first reception control unit 210 determines whether the signal was received in a light-activated automatic reception process (SA9). If the light-activated automatic reception process succeeded (SA9 returns Yes), the first reception control unit 210 deletes the scheduled reception time stored in the storage unit 300, stores the time that the current successful light-activated automatic reception process started (automatic reception success time) as the scheduled reception time in the storage unit 300 (SA10), and goes to step SA8.

However, if scheduled reception was successful (SA9 returns No), the first reception control unit 210 skips step SA10 and goes to step SA8.

Note that even if the automatic reception success time is 12:00:30 in step SA10, the first reception control unit 210 stores 12:00:00 as the scheduled reception time. More specifically, before storing the automatic reception success time as the scheduled reception time, whether the automatic reception success time is contained in any one of plural time periods set at 1-minute intervals is determined, and a specific time in that time period is stored as the automatic reception success time. For example, if the automatic reception success time is in the time period from 12:00:00 to 12:00:59, the value of the seconds unit of the time period is dropped and the time of 12:00:00 is set as the scheduled reception time.

The effect of this first embodiment of the invention is described below.

Because the electronic device 100 has a switching unit 230, operation can be switched between a first reception control unit 210 and a second reception control unit 220 according to the operating environment of the electronic device 100.

When the detected illuminance level of the open circuit voltage detected by the voltage detection circuit 44 is greater than or equal to a second threshold level twice consecutively, the first reception control unit 210 determines that the electronic device 100 is in an environment suited to GPS reception, such as outdoors, and receives a satellite signal. However, if the electronic device 100 is determined to continuously not be in an environment suited to GPS reception for the specific time of 24 hours, satellite signals reception is attempted at a predetermined scheduled reception time.

As a result, reception succeeds more easily when the first reception control unit 210 operates because the electronic device 100 is in an environment suited to GPS reception, such as outdoors. Wasteful power consumption can also be suppressed because reception is not attempted when the electronic device 100 is indoors or other location where the likelihood of reception failing is high unless this condition continues for a specific time or more. In addition, if the electronic device 100 is in an environment suited to GPS reception, such as outdoors, but the electronic device 100 cannot be determined to be located in an environment suited to satellite signal reception because the light incident to the electronic device 100 is weak, for example, satellite signals are received at a predetermined scheduled reception time if this condition continues for a specific time or more.

When the second reception control unit 220 operates, reception occurs only at the scheduled reception time, and wasteful power consumption can be suppressed because reception does not start when the user wearing the electronic device 100 is in a location where the electronic device 100 is exposed to strong light for only a short time and then moves indoors. In addition, because reception is attempted at each scheduled reception time even when the electronic device 100 is used primarily at night, the average interval between reception attempts can be prevented from becoming longer than the interval between the scheduled reception times.

By thus switching between the first reception control unit 210 and second reception control unit 220 according to the usage pattern of the electronic device 100, for example, reception can succeed more easily, power consumption can be reduced, and the average interval between reception attempts can be prevented from becoming longer than the interval between the scheduled reception times.

Furthermore, because the switching unit 230 switches between the first reception control unit 210 and second reception control unit 220 based on input to the input device 60, the user can operate the input device 60 to switch operation between the first reception control unit 210 and second reception control unit 220 at the times best suited to the user's regular activities.

The first reception control unit 210 also sets the variable R to 1 if the light-activated automatic reception process or scheduled reception process is executed. If the variable R is 1 at the time of the next process, the first reception control unit 210 executes only the light-activated automatic reception process and does not execute the scheduled reception process.

Because only the light-activated automatic reception process, which has a higher likelihood of success than the scheduled reception process, is therefore executed as the reception process the next day, satellite signals can be received with less power consumption than when both scheduled reception and light-activated automatic reception processes are executed.

The first reception control unit 210 also sets the time of a successful past light-activated automatic reception process as the scheduled reception time.

As a result, the scheduled reception time can be set according to the user's everyday pattern of life, and the probability of successful reception can be improved. More particularly, by setting the time that the last light-activated automatic reception process succeeded as the scheduled reception time, reception is possible at a time reflecting the most recently daily pattern.

The environment detection circuit includes a charging state detection circuit 43 that detects the illuminance of light incident to the solar cell 135, and a voltage detection circuit 44.

As a result, indoor and outdoor locations can be appropriately differentiated during the day, and the probability of successful reception can be improved.

Instead of storing the automatic reception success time directly as the scheduled reception time, the first reception control unit 210 stores a specific time in a time period containing the automatic reception success time as the automatic reception success time.

This enables the user to more easily know the scheduled reception time.

Furthermore, because the signals received by the electronic device 100 are satellite signals, information for calculating the current location, including the time information and satellite orbit information, can be acquired from the received satellite signals.

Furthermore, because the first reception control unit 210 operates the voltage detection circuit 44 only when charging is detected by the charging state detection circuit 43, the voltage detection circuit 44 is not operated when not charging, that is, when light is not incident to the solar cell 135, and wasteful power consumption can be prevented.

Because the charging state detection process of the charging state detection circuit 43 is performed at 1-second intervals, and the power generation detection process of the voltage detection circuit 44 is only performed when the charging state detection circuit 43 determines that charging is in progress, the operating time of the voltage detection circuit 44, that is, the time that the charging control switch 42 is off, can be minimized. As a result, a drop in the charging efficiency of the solar cell 135 can be suppressed.

Embodiment 2

A second embodiment of the invention is described next with reference to the accompanying figures.

Note that the configuration of the electronic device and the switching process of the switching unit according to this embodiment of the invention are the same as in the first embodiment, and further detailed description thereof is omitted or simplified.

Figure 11:
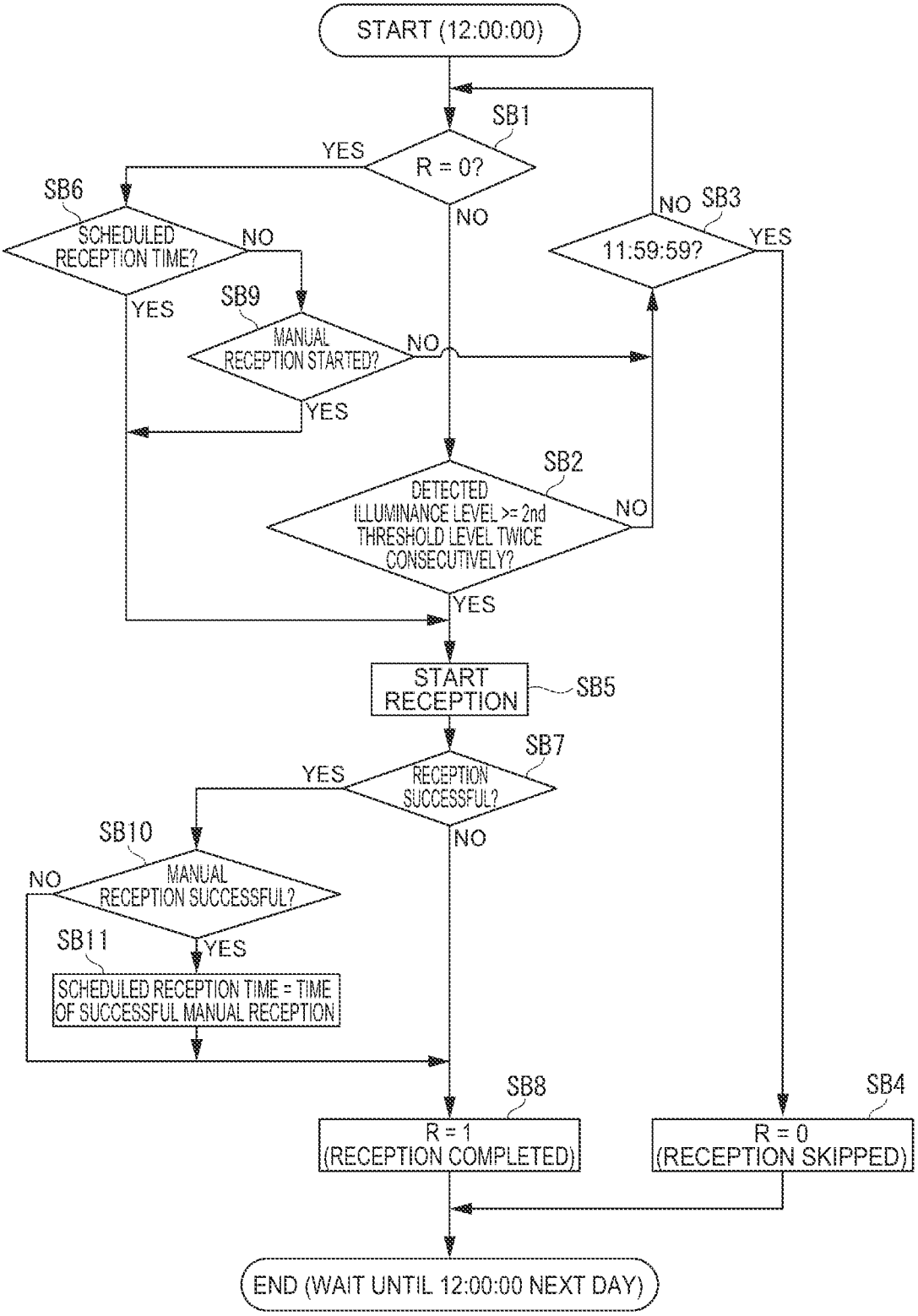
FIG. 11 is a flow chart of a satellite signal reception process executed by the first reception control unit in a second embodiment of the invention.

FIG. 11 is a flow chart of the satellite signal reception process that is executed by the first reception control unit in a second embodiment of the invention.

This embodiment differs from the foregoing first embodiment in that: (i) the scheduled reception time is the time reception started when manual reception succeeded, and (ii) the charging state detection circuit 43 and voltage detection circuit 44 are not operated when variable R=0 (reception was not attempted).

Note that manual reception refers to reception started by the user operating the input device 60 with intent. Also note that steps SB1 to SB8 of the first reception control unit 210 are the same as steps SA1 to SA8 in the first embodiment.

As shown in FIG. 11, when steps SB1 to SB6 are executed, the first reception control unit 210 starts scheduled reception (SB5) if SB6 returns Yes (the current time is the scheduled reception time), and determines if the operation to start reception manually was performed (SB9) if SB6 returns No (the current time is not the scheduled reception time).

The first reception control unit 210 starts manual reception (SB5) if SB9 returns Yes, and goes to step SB3 if SB9 returns No. More specifically, if the reception process is not performed within the specific period of time, the charging state detection circuit 43 and voltage detection circuit 44 are not operated so that the light-activated automatic reception process is not executed, and only scheduled reception or manual reception is executed.

If reception is determined successful in SB7, the first reception control unit 210 determines if it was manual reception that succeeded (SB10). If the successful reception is determined to be manual reception (SB10 returns Yes), the scheduled reception time stored in the storage unit 300 is deleted and the start time of the manual reception process that succeeded this time (manual reception success time) is stored in the storage unit 300 (SB11), and control goes to step SB8. If the reception process was a light-activated automatic reception process or scheduled reception (SB10 returns No), step SB11 is skipped and control goes directly to step SB8.

Note that the second reception control unit 220 also executes the manual reception process when the manual reception process is started in the second embodiment. If manual reception is successful, the scheduled reception time stored in the storage unit 300 is deleted, and the time of the manual reception process that just succeeded is stored in the storage unit 300 as the scheduled reception time.

Note that the first reception control unit 210 and second reception control unit 220 do not store the manual reception success time directly as the scheduled reception time, and instead stores a specific time for the time period containing the manual reception success time as the manual reception success time. These time periods may be set at one minute intervals as in the first embodiment, or at a different interval.

This second embodiment of the invention has the operating effects described below in addition to the same effects as the first embodiment.

If the electronic device remains in an environment not suited to GPS reception for 24 hours or more and the variable R is 0, the first reception control unit 210 does not operate the charging state detection circuit 43 and voltage detection circuit 44 so that the light-activated automatic reception process does not run, and executes the scheduled reception process.

As a result, satellite signals can be received without executing an unnecessary detection process in the light-activated automatic reception mode.

The first reception control unit 210 and second reception control unit 220 store the time that manual reception succeeded in the past as the scheduled reception time.

This is based on the assumption that the user starts manual reception while outdoors so that reception will succeed. As a result, the likelihood that the user is outdoors is high when reception is started manually. The probability of reception succeeding can therefore be increased by scheduling reception for the time when reception was manually started in the past.

Third Embodiment

A third embodiment of the invention is described next with reference to the accompanying figures.

Note that the configuration of the electronic device and the switching process of the switching unit according to this embodiment of the invention is the same as that of the first embodiment, and further detailed description thereof is omitted or simplified.

Figure 12:
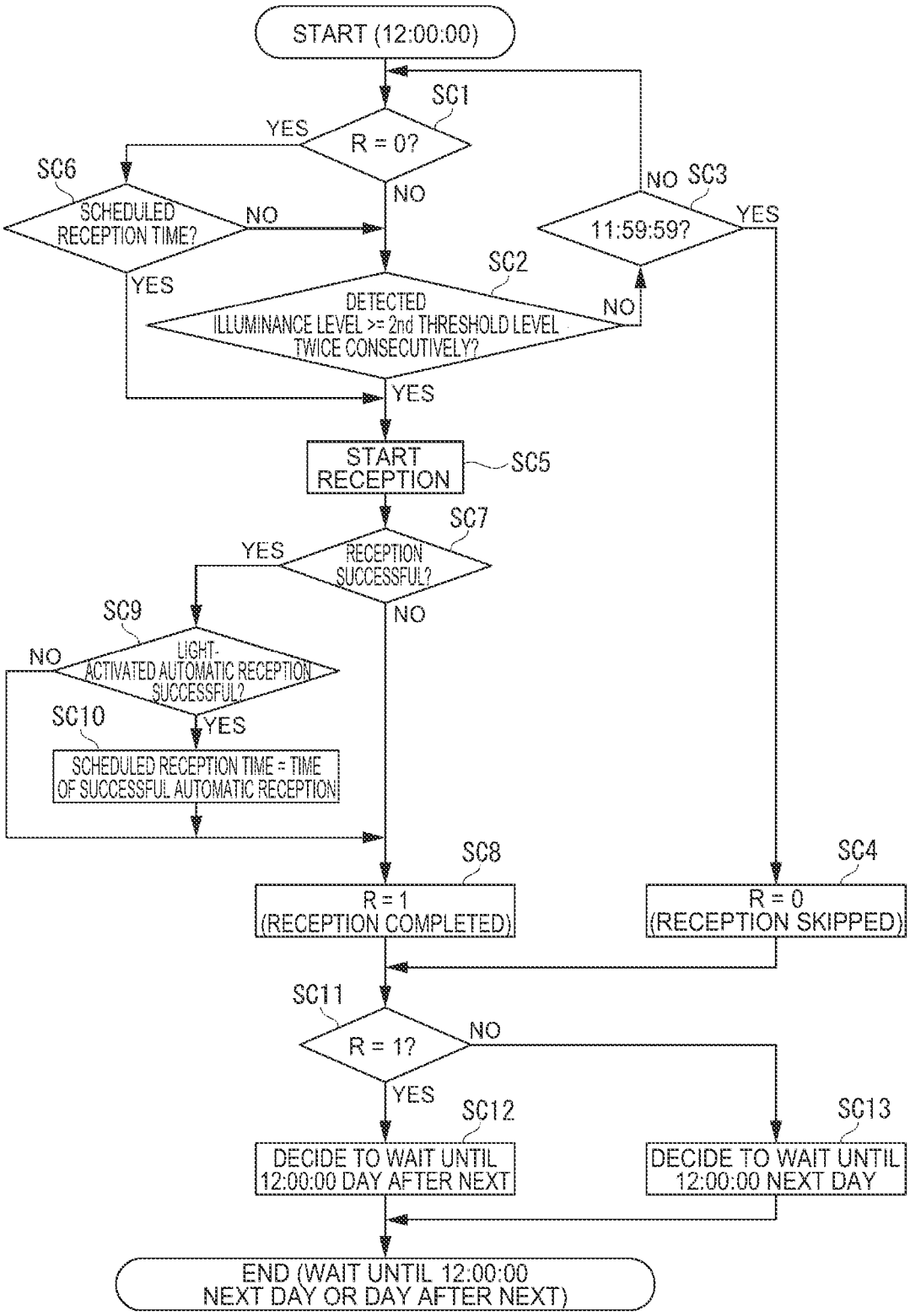
FIG. 12 is a flow chart of a satellite signal reception process executed by the first reception control unit in a third embodiment of the invention.

FIG. 12 is a flow chart of the satellite signal reception process that is executed by the first reception control unit in a third embodiment of the invention.

This embodiment differs from the foregoing first embodiment in that: (i) if a satellite signal was received, the restart control time used as the start control time is set to 12:00:00 the day after next, and if a signal was not received, the restart control time is set to 12:00:00 the next day.

Note that steps SC1 to SC10 of the first reception control unit 210 are the same as steps SA1 to SA10 in the first embodiment.

As shown in FIG. 12, if variable R is set in step SC4 or SC8 while executing steps SC1 to SC10, the first reception control unit 210 determines if variable R=1 (SC11).

If SC11 returns Yes (a reception process was executed), the first reception control unit 210 sets the restart control time to 12:00:00 the day after next (SC12), but sets the restart control time to 12:00:00 the next day if No is returned (a reception process was not executed) (SC13).

In the third embodiment, the second reception control unit 220 drives the GPS receiver circuit 121 once every two days at the scheduled reception time to execute the reception process.

This third embodiment of the invention has the operating effects described below in addition to the same effects as the first embodiment.

If reception is completed, the first reception control unit 210 does not start reception again until the restart reception time the day after next, but if a signal is not received, controls reception to start at the restart reception time the next day.

The reception process consumes power from the storage battery 130, decreasing the amount of power left the day after the reception process is executed. As a result, if the reception process is performed on two consecutive days, the power supply could become depleted during reception and reception will be interrupted. Because this embodiment of the invention does not run the reception process the day after the reception process is executed, the storage battery 130 can be recharged the next day, and the chance of reception being interrupted can be reduced.

However, sufficient power remains in the storage battery 130 the day after the reception process is not executed. As a result, the reception process can be performed on the next day and the satellite signal can be received promptly without running out of power during reception.

Fourth Embodiment

A fourth embodiment of the invention is described next with reference to the accompanying figures.

Note that the configuration of the electronic device and the switching process of the switching unit according to this embodiment of the invention are the same as in the first embodiment, and further detailed description thereof is omitted or simplified.

Figure 13:
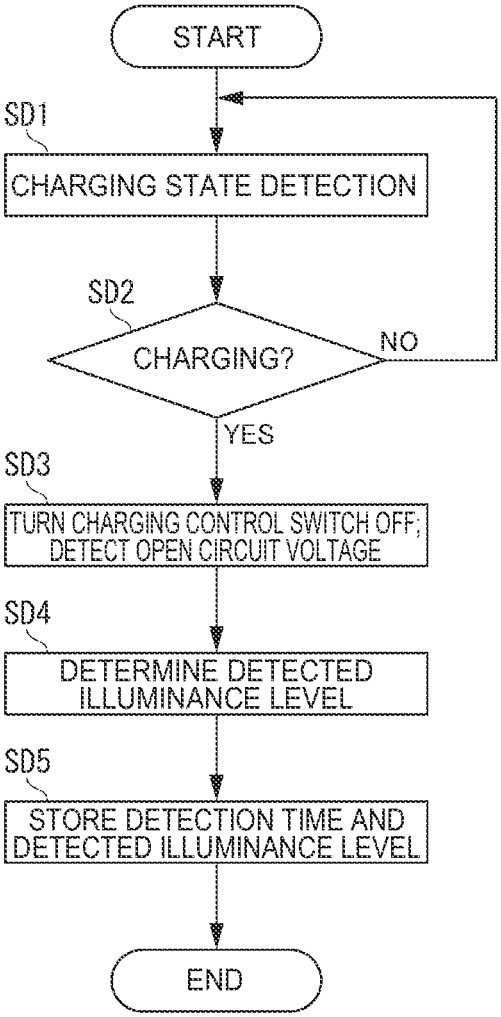
FIG. 13 is a flow chart of the detected illuminance level storage process of the control circuit in a fourth embodiment of the invention.
Figure 15:
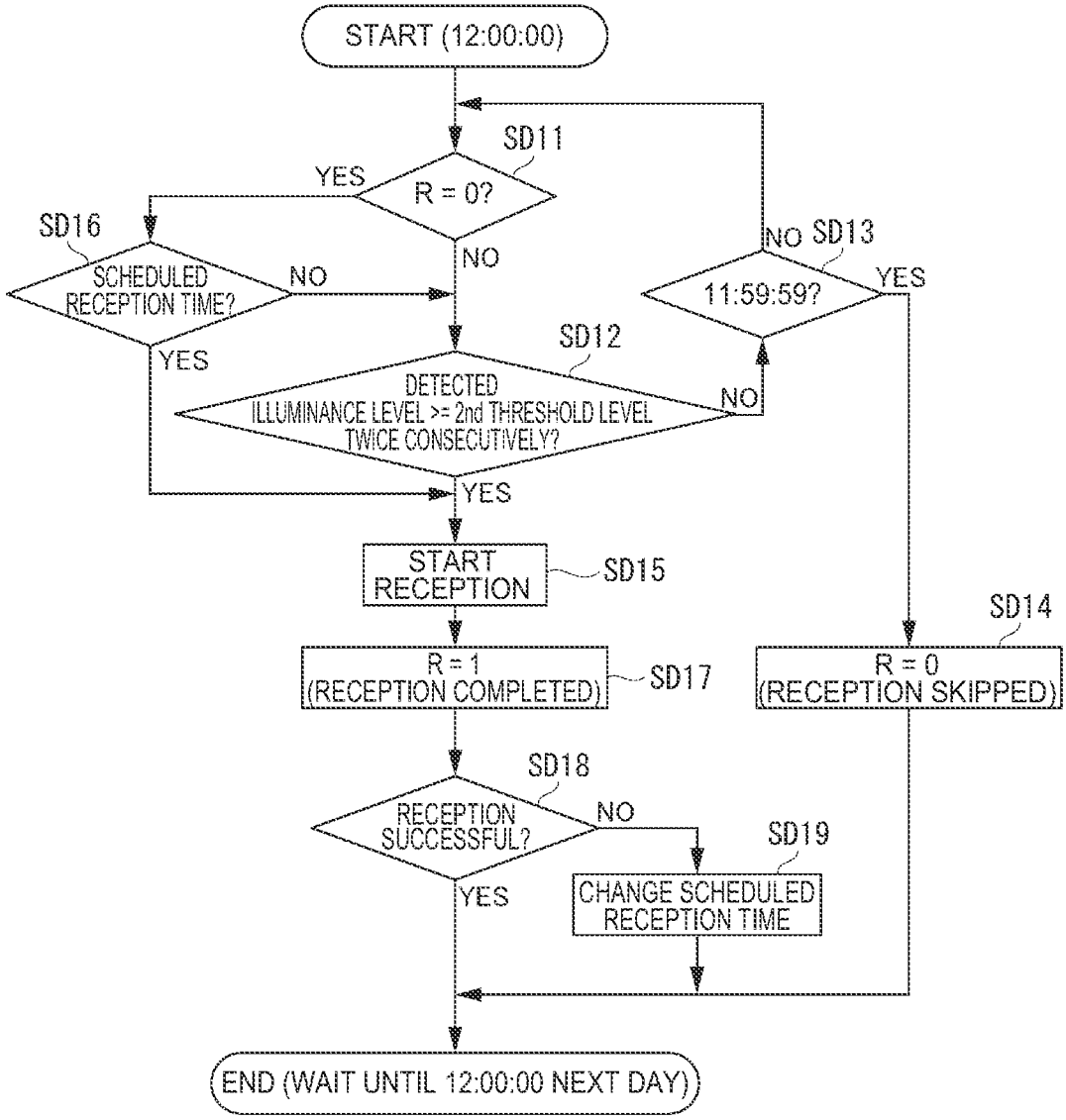
FIG. 15 is a flowchart of a satellite signal reception process executed by the first reception control unit in fourth and fifth embodiments of the invention.

FIG. 13 is a flow chart of the detected illuminance level storage process of the control circuit 200 in a fourth embodiment of the invention. FIG. 14 shows the relationship between the detection time and detection count at each of the detected illuminance levels used to set the scheduled reception time. FIG. 15 is a flow chart of a satellite signal reception process of the first reception control unit.

This embodiment differs from the foregoing first embodiment in that: (i) the scheduled reception time is set based on the detection time and detection count of detected illuminance levels detected in the past.

Note that steps SD11 to SD17 of the first reception control unit 210 are the same as steps SA1 to SA6 and SA8 in the first embodiment.

The control circuit 200 performs an detected illuminance level storage process the first time the electronic device 100 is used, or after a system reset, and stores several days or several hours of data. The detected illuminance level storage process is also performed during the satellite signal reception process as shown in FIG. 15 and described below to accumulate data.

More specifically, the control circuit 200 operates the charging state detection circuit 43 on a regular period at a specific time interval or when the user presses a button (SD1). This regular period may be a period such as 1 second, 5 seconds, 10 seconds, 1 minute, or 30 minutes, for example. The period can be determined based on the storage capacity of the storage unit 300 or consumption of storage battery 130 power. More specifically, if the storage capacity of the storage unit 300 is large, the period could be shortened to store more data so that the scheduled reception time can be set more appropriately as described below. Alternatively, if suppressing consumption of power from the storage battery 130 is desirable, the period can be lengthened. The detected illuminance level storage process can also be blocked during the night because the detected illuminance level detected at night will be low if the user is outdoors.

The control circuit 200 then determines if the battery is being charged (SD2), and if the battery is not being charged (SD2 returns No), returns to SD1. If SD2 determines that charging is in progress (SD2 returns Yes), the control circuit 200 turns the charging control switch 42 off and detects the open circuit voltage corresponding to the illuminance of light incident to the solar cell 135 (SD3).

The control circuit 200 determines the detected illuminance level corresponding to the open circuit voltage based, for example, on the relationship shown in FIG. 10 (SD4), stores this detected illuminance level together with the time of this level was detected (SD5), and ends the process. More specifically, before storing the illuminance detection time, the control circuit 200 determines which of the plural time periods set at a 1-minute interval contains the detection time, and stores a specific time in that time period as the detection time together with the detected illuminance level. For example, if the illuminance detection time is in the time period from 20:00:00 to 20:00:59, the value of the seconds unit of the time period is dropped and the time of 20:00:00 is stored as the detection time.

Note that this time period is not limited to 1-minute periods, and could be set to a period of 5 minutes, 10 minutes, 15 minutes, or 30 minutes, for example. The detection time is also not limited to dropping the seconds unit, and both the seconds unit and minute unit may be dropped. For example, if the time period is set to 10 minutes, the detection time set for the time period from 19:55:00 to 20:04:59 may be set to the beginning time of 19:55:00 or a middle time of 20:00:00.

If the same combination of detected illuminance level and detection time is already stored in the storage unit 300, the control circuit 200 increments the detection count of that combination the next time it is stored. If a particular combination of detected illuminance level and detection time is not already stored in the storage unit 300, the control circuit 200 stores that new combination and sets the detection count to 1.

The control circuit 200 also resorts the data in order of the highest detected illuminance level and highest detection count, and determines the order of priority in which the detection time of the detected illuminance level is set as the scheduled reception time. More specifically, as shown in FIG. 14, the first reception control unit 210 sorts the data from high to low based on the detected illuminance level, and then sorts entries having the same detected illuminance level from high to low based on the detection count. The order of priority is then set in this order. Note that the order of priority is shown in FIG. 14 with a lower value indicating higher priority.

Note that a configuration that does not store the detection count in the storage unit 300, stores only the detected illuminance level and detection time, and determines the detection count by counting the number of same combinations of detected illuminance level and detection time, is also conceivable. In addition, the data is sorted in the order of priority in this example, but the order of priority could be set without reordering the data.

As shown in FIG. 15, the first reception control unit 210 also executes the satellite signal reception process of steps SD11 to SD19. In this process the detection time with the highest priority is set as the scheduled reception time based on the past detection results of the detected illuminance level stored in the storage unit 300. The time 20:00:00 with priority level 1 is therefore set as the scheduled reception time in step SD16 in FIG. 14.

The first reception control unit 210 then determines if reception was successful after step SD17 (SD18). If SD18 returns Yes, the first reception control unit 210 does not change the scheduled reception time and enters a standby mode until the restart control time of 12:00:00 the next day.

However, if SD18 returns No, the first reception control unit 210 changes the scheduled reception time (SD19), and enters the standby mode until 12:00:00 the next day. More specifically, of the detection times other than the detection time set as the scheduled reception time, the first reception control unit 210 sets the detection time with the highest priority setting (the detection time of the highest detected illuminance level with the highest detection count) as the scheduled reception time. As described above, the control circuit 200 executes the detected illuminance level storage process parallel to the satellite signal reception process. As a result, the first reception control unit 210 changes the scheduled reception time based on the most recent data. For example, if scheduled reception at the highest priority setting (1) of 20:00:00 in FIG. 14 fails, the time 7:00:00 of the next highest priority setting (2) is set as the scheduled reception time.

The detection time with the highest priority setting is also set as the scheduled reception time based on the previously stored results of illuminance level detection stored in the storage unit 300 when the second reception control unit 220 executes the reception process in the fourth embodiment.

When reception at the scheduled time fails, the second reception control unit 220 in this embodiment also sets the scheduled reception time to the detection time with the highest priority setting among the detection times other than the detection time set as the scheduled reception time, and does not change the scheduled reception time when reception is successful at the scheduled time.

This fourth embodiment of the invention has the operating effects described below in addition to the same effects as the first embodiment.

The control circuit 200 stores detected illuminance levels detected in the past together with the detection time of each detected illuminance level in the storage unit 300, and sets the detection time of the highest detected illuminance level as the scheduled reception time.

As a result, scheduled reception is possible at a time when the environment should be relatively free of buildings and other obstructions to satellite signals, and the probability of successful reception can be increased.

Of the detection times of the highest detected illuminance level, the control circuit 200 sets the detection time of the detected illuminance level with the highest detection count as the scheduled reception time.

The probability of successful reception can therefore be increased by attempting reception at the detection time with the highest detection count selected from among the times when a high illuminance level was detected in the past.

The control circuit 200 sets the priority level at which the detection time is set as the scheduled reception time in order of the highest detected illuminance level and the highest detection count. If scheduled reception fails, the first reception control unit 210 and second reception control unit 220 set the detection time with the highest priority setting selected from among the detection times other than the detection time set as the scheduled reception time as the scheduled reception time, and not change the scheduled reception time if scheduled reception succeeds.

As a result, if reception fails at the time when illuminance was highest in the past because the user's daily pattern changed or the detected illuminance level becomes as high as the outdoors due to lighting effects, the next scheduled reception occurs at the time of the next highest illuminance or next highest detection count, and the probability of success in the next scheduled reception can be increased.

Fifth Embodiment

A fifth embodiment of the invention is described next with reference to the accompanying figures.

Note that the configuration of the electronic device and the switching process of the switching unit according to this embodiment of the invention are the same as in the first embodiment, the satellite signal reception processes of the first reception control unit and the second reception control unit in this embodiment are the same as in the fourth embodiment, and further detailed description thereof is omitted or simplified.

Figure 16:
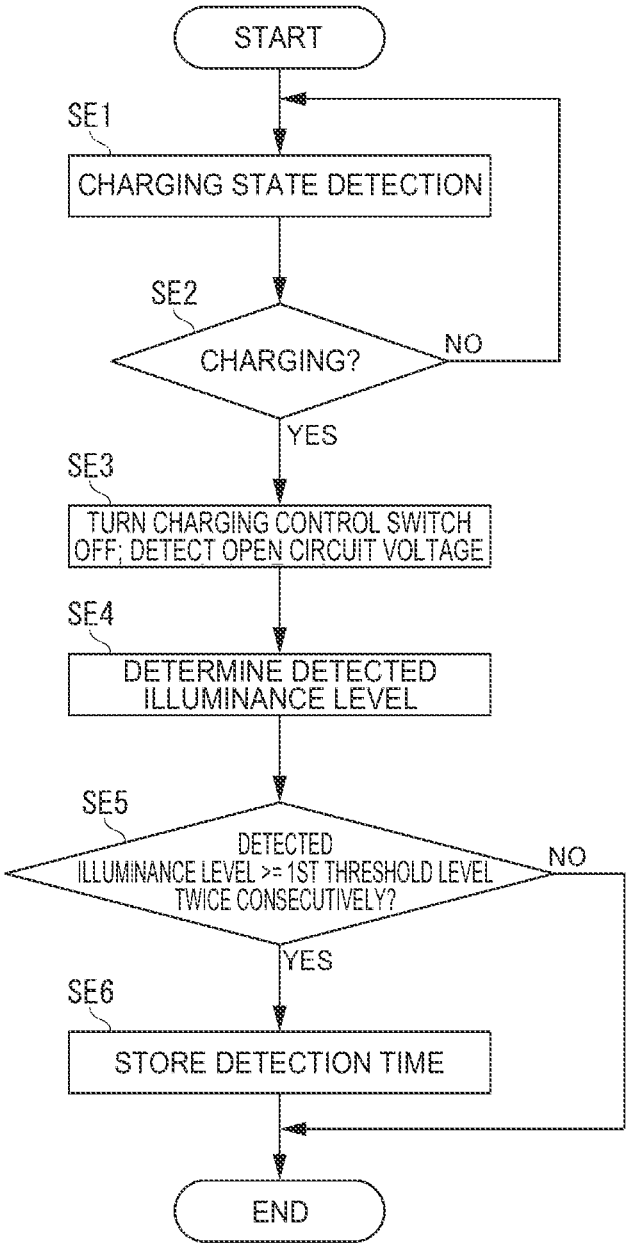
FIG. 16 is a flow chart of the detection time storage process of the control circuit in the fifth embodiment of the invention.

FIG. 16 is a flow chart of the detection time storage process of the control circuit in this fifth embodiment of the invention. FIG. 17 shows the detection counts of the detection times used to set the scheduled reception time.

This embodiment differs from the foregoing fourth embodiment in that: (i) the scheduled reception time is set based on the detection time when the detected illuminance level exceeded a first threshold level used as a first threshold value in the past, and the detection count.

Note that steps SE1 to SE4 of the control circuit 200 are the same as steps SD1 to SD4 in the fourth embodiment.

The control circuit 200 performs a detection time storage process such as shown in FIG. 16 the first time the electronic device 100 is used, or after a system reset, and stores several days or several hours of data. The detection time storage process is also performed during the satellite signal reception process described below to accumulate data.

More specifically, the control circuit 200 executes steps SE1 to SE4, and determines if the detected illuminance level corresponding to the open circuit voltage detected in SE4 is greater than or equal to a first threshold level (such as 5) twice consecutively (SE5). Note that this first threshold level is set based on the relationship shown in FIG. 10, and may be set to a level other than 5.

If the detected illuminance level is determined to not exceed the first threshold level twice consecutively (SE5 returns No), the control circuit 200 ends the process. However, if the detected illuminance level exceeds the first threshold level twice consecutively (SE5 returns Yes), the control circuit 200 stores the detection time of the detected illuminance level determined by the same process as in the fourth embodiment (SE6), and then ends the process. More specifically, if the detection time based on the detection result used in SE5 is already stored in the storage unit 300, the control circuit 200 increases the detection count of that detection time 1. If the detection time based on the detection result used in SE5 is not already stored in the storage unit 300, the control circuit 200 stores the new detection time and sets the detection count to 1.

The control circuit 200 then reorders the data in order of the highest detection count, and sets the priority level for setting the detection time as the scheduled reception time. More specifically, as shown in FIG. 17, the control circuit 200 first sorts the data from high to low by detection count, and sets the priority level in the sorted order. Note that the priority levels shown in FIG. 17 use a lower value to indicate higher priority.

Because the time period and detection times are set in 15-minute increments in this fifth embodiment, the number of scheduled reception times to be managed is smaller than in the fourth embodiment where a 1-minute period is used, and the user can more easily know the scheduled reception time. The storage capacity of the storage unit 300 can also be reduced.

The first reception control unit 210 also executes the satellite signal reception process of steps SD11 to SD19 as shown in FIG. 15. In this embodiment, the control circuit 200 sets the detection time with the highest detection count as the scheduled reception time used for evaluation in SD16 based on the past detection results stored in the storage unit 300.

To change the scheduled reception time in SD19, the first reception control unit 210 sets the detection time with the highest priority (highest detection count) selected from among the detection times other than the detection time currently set as the scheduled reception time as the scheduled reception time. Because the control circuit 200 executes the detected illuminance level storage process parallel to the satellite signal reception process as described above, the scheduled reception time is changed When the second reception control unit 220 executes the reception process in this fifth embodiment, the control circuit 200 also sets the detection time with the highest detection count as the scheduled reception time based on the detection results previously stored in the storage unit 300.

When reception at the scheduled time fails, the second reception control unit 220 in this embodiment also sets the scheduled reception time to the detection time with the highest priority setting among the detection times other than the detection time set as the scheduled reception time, and does not change the scheduled reception time when reception is successful at the scheduled time.

This fifth embodiment of the invention has the operating effects described below in addition to the same effects as the first and fourth embodiments.

When the detected illuminance level is greater than or equal to a first threshold level twice consecutively, the control circuit 200 sets the detection time of that detection level as the scheduled reception time.

As a result, the probability of successful reception can be increased by selecting for reception a time when the detected illuminance level equalled or exceeded the first threshold level in the past. In addition, by setting a value enabling detecting that the user is outdoors as the first threshold level, scheduled reception is possible timed to when the user is outdoors.

If the detected illuminance level is greater than or equal to the first threshold level twice consecutively, the control circuit 200 stores the detection count with the detection time of the detected illuminance level. The control circuit 200 then sets the detection time with the highest detection count as the scheduled reception time.

As a result, by executing the scheduled reception process at the time with the highest detection count, reception can be timed to when the likelihood is high that the user is outdoors and the probability of reception succeeding can be increased, even when there are plural times when the detected illuminance level exceeded the first threshold level in the past.

Sixth Embodiment

A sixth embodiment of the invention is described next with reference to the accompanying figures.

Note that the configuration of the electronic device and the satellite signal reception processes of the first reception control unit and the second reception control unit in this embodiment are the same as in the first embodiment described above, and further detailed description thereof is omitted or simplified.

Figure 18:
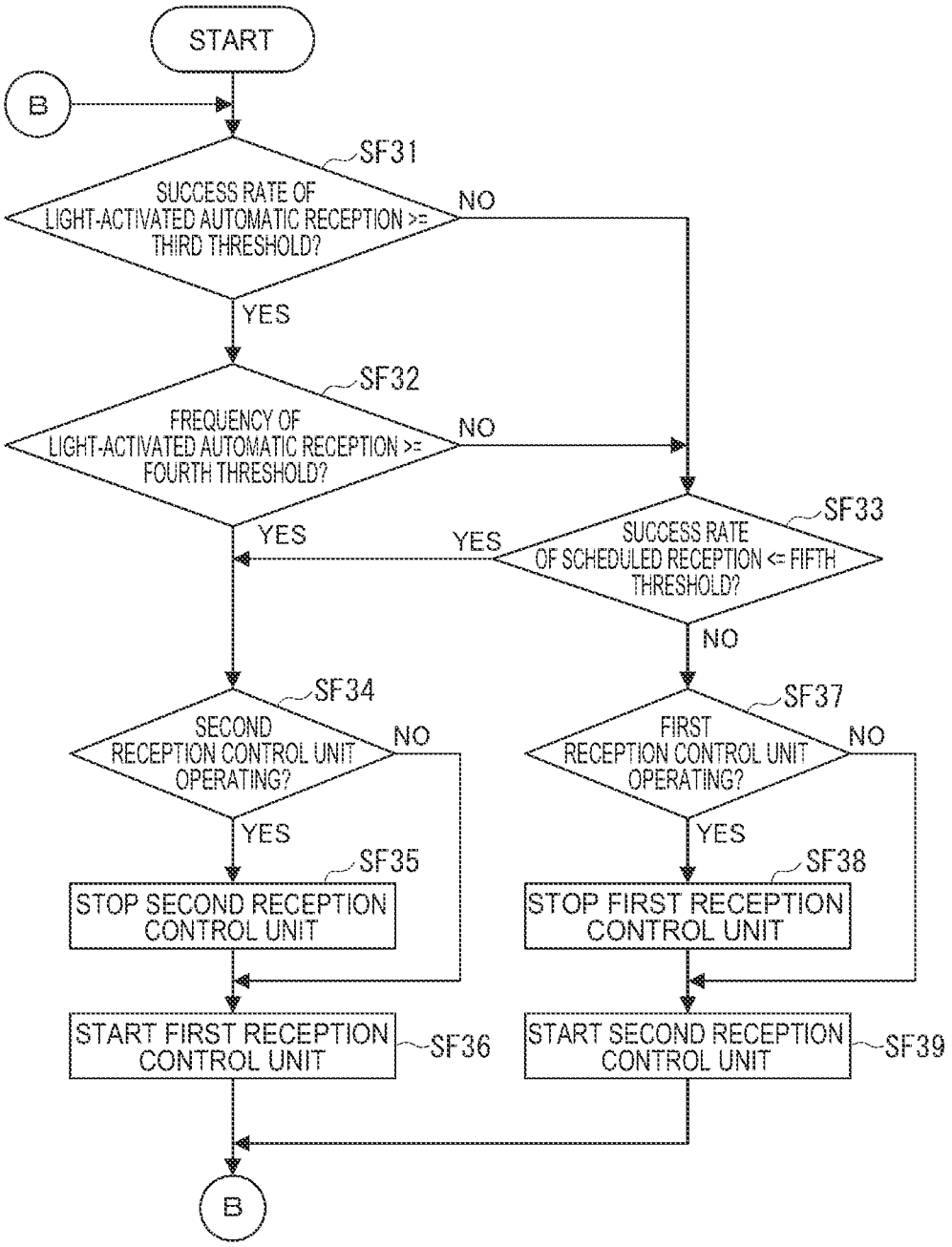
FIG. 18 is a flow chart of the switching process of the switching unit in the sixth embodiment of the invention.

FIG. 18 is a flow chart of the switching process of the switching unit in this sixth embodiment of the invention.

This embodiment differs from the foregoing first embodiment in that: (i) the switching process of the switching unit 230 is executed automatically based on the satellite signal reception history.

When the reception process is executed by the first reception control unit 210 or second reception control unit 220 in this embodiment, the control circuit 200 stores a reception history including the type of reception process (light-activated automatic reception or scheduled reception) and the reception result indicating if reception was successful in the storage unit 300. As a result, the reception history accumulates in the storage unit 300 each time the reception process executes. The control circuit 200 also deletes the oldest records in the reception history stored in the storage unit 300 from the storage unit 300 after one month. More specifically, the reception history of the most recent month is stored.

As shown in FIG. 18, the switching unit 230 first references the reception history stored in the storage unit 300, and determines if the success rate of the light-activated automatic reception processes equals or exceeds a third threshold (SF31). This third threshold is set to the minimum level (such as 80%) at which the success rate can be determined to be relatively high.

If SF31 returns Yes, the switching unit 230 references the reception history and determines if the frequency of light-activated automatic reception equals or exceeds a fourth threshold (SF32). This fourth threshold is set to the minimum level (such as an average 0.8 times/day) at which the frequency can be determined to be relatively high.

If SF31 returns No, or SF32 returns No, the switching unit 230 references the reception history and determines if the success rate of scheduled reception equals or exceeds a fifth threshold (SF33). This fifth threshold is set to the maximum level (such as 20%) at which the success rate can be determined to be relatively low.

If SF31 returns Yes, the probability of success in the light-activated automatic reception process can be expected to be high and the likelihood of wasteful power consumption low if the first reception control unit 210 operates.

If SF32 returns Yes, the probability the light-activated automatic reception process will be executed within a specific time (24 hours) can be expected to be high, and the likelihood that the average reception interval will become longer than the interval between scheduled reception times low, if the first reception control unit 210 operates.

Therefore, if SF31 returns Yes and SF32 returns Yes, the switching unit 230 goes to step S34 to operate the first reception control unit 210.

However, if SF31 returns No or SF32 returns No but SF33 returns Yes, the likelihood of success in the scheduled reception process can be expected to be low, and the likelihood of successful reception can be expected to be low even if the second reception control unit 220 operates. As a result, the switching unit 230 goes to step S34 to operate the first reception control unit 210.

In SF34, the switching unit 230 determines if the second reception control unit 220 is operating. If SF34 returns Yes, the switching unit 230 stops operation of the second reception control unit 220 (SF35).

After step SF35, or if SF34 returns No, the switching unit 230 operates the first reception control unit 210 (SF36). The switching unit 230 then returns to SF31.

However, if SF31 returns No or SF32 returns No and SF33 returns No, the following steps execute to operate the second reception control unit 220.

More specifically, the switching unit 230 determines if the first reception control unit 210 is operating (SF37). If SF34 returns Yes, the switching unit 230 stops operation of the first reception control unit 210 (SF38).

After step SF38, or if SF37 returns No, the switching unit 230 operates the second reception control unit 220 (SF39). The switching unit 230 then returns to SF31.

Note that in addition to the switching process according to this embodiment, the switching process based on input to the input device 60 as described in the first embodiment may be executed.

This sixth embodiment of the invention has the operating effects described below in addition to the same effects as the first embodiment.

The switching unit 230 references a reception history, and if the success rate of the light-activated automatic reception process is greater than or equal to a third threshold, and the frequency of light-activated automatic reception is greater than or equal to a fourth threshold, operates the first reception control unit 210. Otherwise, the switching unit 230 operates the second reception control unit 220 unless the success rate of scheduled reception is less than a fifth threshold. As a result, operation can be switched at an appropriate time between the first reception control unit 210 and second reception control unit 220. Ease of use can also be improved because operation can be switched automatically between the first reception control unit 210 and second reception control unit 220, and user input to the input device 60 is not necessary.

OTHER EMBODIMENTS

The invention is not limited to the foregoing embodiments, and can be varied in many ways without departing from the scope of the invention.

For example, the scheduled reception time may be set based on a relationship such as shown in FIG. 19 in the first to third embodiments (first variation).

More specifically, the first reception control unit 210 and second reception control unit 220 store the time when light-activated automatic reception or manual reception succeeded in the past relationally to the order of success in the storage unit 300. This example stores a maximum of 10 reception success times, but the maximum is not limited to 10. In the example shown in FIG. 19, the reception success time at number 1 in the order of success is the newest time, and 10 indicates the tenth-newest time. The first reception control unit 210 and the second reception control unit 220 first set the first newest time of 6:10:00 as the scheduled reception time, start the next scheduled reception at the same time if scheduled reception is successful at this time, and if reception fails at this time, may set the second-newest time of 6:15:00 as the scheduled reception time for the next reception.

The scheduled reception time may also be set based on a relationship such as shown in FIG. 20 in the first to third embodiments (second variation).

More specifically, the first reception control unit 210 and second reception control unit 220 store the number of times light-activated automatic reception and manual reception were performed in each time period in the past and the number of times reception succeeded in the storage unit 300. The first reception control unit 210 and second reception control unit 220 then first set the time 6:00:00 with the first-highest reception success count as the scheduled reception time, and starts the next scheduled reception at the same time if scheduled reception succeeds at that time. If reception fails, however, the first reception control unit 210 and second reception control unit 220 set the time 8:00:00 with the second-highest reception success count as the next scheduled reception time.

As a result, because reception is performed next at the time with the next highest success count if reception fails at the time with the highest success count in the past, the probability of success in the next reception process can be increased when the user's daily pattern has changed, for example.

Note that the scheduled reception time could be set in order based on the success rate (successful reception count/reception count) or the failure rate instead of the successful reception count.

Reception may also be scheduled in the first to sixth embodiments and the first and second variations described above with additional consideration for a relationship such as shown in FIG. 21 (third variation).

More specifically, the first reception control unit 210 and second reception control unit 220 store the number of times reception succeeded in light-activated automatic reception and manual reception processes in the past on each day of the week. The first reception control unit 210 and second reception control unit 220 then schedule reception only on Monday, the day with the highest success count in this example, and if scheduled reception succeeds, schedules the next reception only on the same day. If reception fails, the first reception control unit 210 and second reception control unit 220 schedule the next reception only on Friday, the day with the second-highest success count.

Further alternatively, if the satellite signal reception process of the first reception control unit 210 fails once in the first to sixth embodiments and the first to third variations, the reception process could be executed after waiting a specific time of 1 minute, 10 minutes, or 30 minutes, for example, and the reception process could be ended once reception fails a specific number of times.

Further alternatively, a time selected by the user from among plural times stored in the storage unit 300 may be set as the scheduled reception time in the fourth and fifth embodiments and the first to third variations described above.

Yet further alternatively, when scheduled reception fails in the fourth and fifth embodiments and the first to third variations described above, the control circuit 200 may omit that scheduled reception time from the candidates for setting the next scheduled reception time.

By removing the time at which reception fails from the candidate times for setting the next reception time, this configuration can reduce the probability that reception will fail because the user is indoors at a time when reception succeeded in the past as a result of the user's daily pattern changing, for example.

The satellite signal reception process starts based on the detected illuminance level above, but a configuration that uses detection of humidity, temperature, or atmospheric pressure as the environment detection circuit, and determines the device is in an environment suited to GPS reception, such as outdoors, and starts the satellite signal reception process when the humidity, temperature, or atmospheric pressure exceeds a specific level, is also conceivable. This is useful when the satellite signal reception device is used in mountain climbing because atmospheric pressure is significantly different at high and low altitudes.

A light sensor such as a UV sensor may also be used instead of the solar cell 135 to detect the amount of incident light.

The second embodiment may also store both the success times of light-activated automatic reception and the success times of manual reception in the storage unit 300, and set the most recent success time as the scheduled reception time.

This configuration can schedule reception based on the user's most recent pattern of daily life. The methods of setting the scheduled reception time described in the first, second, fourth, and fifth embodiments may also be combined as needed, and the time selected by the method of the first, second, fourth, or fifth embodiment may be set as the scheduled reception time based on a specific condition.

The scheduled reception time may also be changed even if satellite signal reception process fails in the fourth and fifth embodiments.

A specific time set for a predetermined time period is stored as the detection time in the storage unit 300 in the first to sixth embodiments, but the reception success time and illuminance detection time could be stored directly.

Furthermore, in the fifth embodiment the first threshold level may be higher than the second threshold level or lower instead of setting the first threshold level and second threshold level to the same level.

For example, the following effect can be expected if the first threshold level is higher than the second threshold level. That is, by setting the first threshold level to a level corresponding to outdoors on a clear day (a "high illuminance level" below), a time when the user is outdoors can be reliably set as the scheduled reception time.

If the second threshold level is set to the same high illuminance level as the first threshold level, and the user is outdoors at the scheduled reception time but illuminance of the high illuminance level cannot be detected because it is cloudy or raining, or the electronic device 100 is covered by a sleeve, starting the reception process may not be possible because the detected illuminance level will not go to or above the second threshold level.

However, if the second threshold level is set lower than the first threshold level and the user is outdoors at the scheduled reception time, the detected illuminance level will be able to go to the second threshold level or above even if it is cloudy or raining, or the electronic device 100 is covered by a sleeve, and the reception process can be started.

Opportunities for reception at a time when the user is reliably outdoors can therefore be increased, and satellite signals can be received frequently with a high probability of success.

The illuminance detection circuit in the foregoing embodiments outputs a detection value that rises as the illuminance of light incident to the solar cell 135 increases, but the output value is not limited to a value that rises as the illuminance of light incident to the solar cell 135 increases. More specifically, the detection value could be a value that decreases as the illuminance of light incident to the solar cell 135 increases. An example of a case in which the detection value decreases as the illuminance of light incident to the solar cell 135 increases is when a device in which the open circuit voltage decreases as the illuminance of light incident to the solar cell 135 increases is used.

In the foregoing embodiments, when the electronic device 100 is determined to continuously be in an environment not suited to satellite signal reception for a specific time or longer, the first reception control unit 210 executes the satellite signal reception process at the scheduled reception time, but may omit executing the reception process at the scheduled reception time.

An electronic device 100 having a radio signal receiver according to the invention is not limited to a wristwatch (electronic timepiece), and the invention can be used in a wide range of devices that are driven by a storage battery and receive satellite signals sent from positioning information satellites, including cellular phones and mobile GPS receivers used for mountain climbing, for example.

Furthermore, by using a solar cell 135, storage battery 130, charging control switch 42, and voltage detection circuit 44, the invention can detect the illuminance of light incident to the solar cell 135 with great accuracy. The illuminance detection mechanism embodied as described above is also not limited to use only in electronic devices that receive satellite signals, and can be used in other devices. The invention is particularly suited to devices that start some other device by detecting illuminance. For example, the invention can be applied in devices that turn lights on/off or adjust the brightness of lighting according to the detected illuminance, and in long-wave radio-controlled timepieces that start reception based on the illuminance. The radio signal receiver according to the invention can also be used in electronic devices that use the solar cell 135 only for illuminance detection.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2014-090260, filed Apr. 24, 2014 is expressly incorporated by reference herein.

What is claimed is:

1. A radio signal receiver that receives radio signals, comprising:

a reception circuit that receives the signals;

an environment detection circuit that detects whether or not the radio signal receiver is in an environment suited to signal reception; and a control circuit that controls the reception circuit and the environment detection circuit, and includes:

a first reception control unit that, if a current time is not a scheduled reception time, operates the reception circuit when the radio signal receiver is determined to be in an environment suited to signal reception based on the detection result from the environment detection circuit, a second reception control unit that operates the reception circuit at a preset scheduled reception time irrespective of any detection results from the environmental detection circuit, and a switching unit that switches operation between the first reception control unit and second reception control unit;

wherein the first reception control unit and second reception control unit are independent of each other, and only one of the first reception control unit and second reception unit operates at any given time in accordance with the switching unit.

2. The radio signal receiver described in claim 1, further comprising:

an input device;

the switching unit switching operation between the first reception control unit and second reception control unit based on input to the input device.

3. The radio signal receiver described in claim 1, wherein:

the switching unit switches operation between the first reception control unit and second reception control unit based on a reception history, which is a history of reception by the reception circuit.

4. The radio signal receiver described in claim 1, wherein:

the first reception control unit further includes a timed-reception control sub-unit that operates the reception circuit at the preset scheduled reception time, while the second reception control unit is not operating, in response to the radio signal receiver being determined to not be in an environment suited to signal reception continuously for a minimum specific time, as determined from multiple detections of the environment detection circuit.

5. The radio signal receiver described in claim 1, wherein:

the first reception control unit further includes a timed-reception control sub-unit that operates the reception circuit at the preset scheduled reception time while the second reception control unit is not operating;

the first reception control unit stops operation of the environment detection circuit and initiates operation of the timed-reception control sub-unit in response to the radio signal receiver being determined to not be in an environment suited to signal reception continuously for a minimum specific time, as determined from multiple, consecutive detections of the environment detection circuit.

6. The radio signal receiver described in claim 5, wherein:

after operating the reception circuit by the timed-reception control unit, the first reception control unit does not operate the reception circuit at the scheduled reception time when the radio signal receiver is determined to not be in an environment suited to signal reception continuously for a specific time or longer, and operates the reception circuit when the radio signal receiver is determined to be in an environment suited to signal reception.

7. The radio signal receiver described in claim 1, wherein:

the first reception control unit sets the time of successful signal reception when the radio signal receiver is determined to be in an environment suited to signal reception as the scheduled reception time.

8. The radio signal receiver described in claim 1, wherein:

the first reception control unit or second reception control unit operate the reception circuit when a manual reception command is asserted, and set the time of successful signal reception initiated by a manual reception command as the scheduled reception time.

9. The radio signal receiver described in claim 7, further comprising:

a storage unit;

wherein the first reception control unit and the second reception control unit store their respective reception successes times in the storage unit, and when a plurality of reception success times are stored, the success time with the highest reception success count is set as the scheduled reception time.

10. The radio signal receiver described in claim 9, wherein:

when signal reception fails at the scheduled reception time, the scheduled reception time is changed to the success time with the second highest success count, and when signal reception succeeds at the scheduled reception time, the scheduled reception time is not changed.

11. The radio signal receiver described in claim 1, wherein:

the scheduled reception time is selected from among a plurality of starting times of consecutive time slots;

the first reception control unit or second reception control unit each determine in which time slots current successful signal reception is contained, and set the scheduled reception time to the starting time of the time slots containing the current successful signal reception.

12. The radio signal receiver described in claim 1, wherein:

the first reception control unit has a plurality of consecutive start control times independent of the preset scheduled reception time, time periods between consecutive start control times defining independent operation cycles during which the first reception control unit may operate;

if while activated during a current one of the independent operation cycles, the first reception control unit does not operate the reception circuit, then the first reception control unit is set to start its next operation cycle at the next consecutive start control time, otherwise, the first reception circuit is set to start its next operation cycle at the start control time that follows the next consecutive start control time.

13. The radio signal receiver described in claim 1, further comprising:

a solar cell;

an illuminance detection circuit that detects the illuminance of light incident to the solar cell; and a storage unit;

wherein the control circuit:

operates the illuminance detection circuit at a specific time interval, stores the illuminance detected by the illuminance detection circuit and the illuminance detection time in the storage unit, and sets the detection time of the highest illuminance in a specific period as the scheduled reception time.

14. The radio signal receiver described in claim 13, wherein:

when there are plural detection times for the highest detected illuminance, the control circuit sets the detection time of the highest detected illuminance that was detected the most times as the scheduled reception time.

15. The radio signal receiver described in claim 1, further comprising:

a solar cell;

an illuminance detection circuit that detects the illuminance of light incident to the solar cell; and a storage unit;

wherein the control circuit operates the illuminance detection circuit at a specific time interval, stores the detection time of the illuminance in the storage unit when the illuminance detected by the illuminance detection circuit is greater than or equal to a preset first threshold value, and sets the detection time stored in the storage unit as the scheduled reception time.

16. The radio signal receiver described in claim 15, wherein:

when plural detection times are stored, the control circuit sets the detection time at which the illuminance was detected greater than or equal to a preset first threshold value the most times as the scheduled reception time.

17. The radio signal receiver described in claim 13, wherein:

the control circuit determines which of plural time periods set at a specific time interval contains the detection time, and stores a specific time in the time period containing the detection time in the storage unit.

18. The radio signal receiver described in claim 1, further comprising:

a solar cell;

wherein the environment detection circuit is an illuminance detection circuit that detects the illuminance of light incident to the solar cell as the detection process detecting if the radio signal receiver is in an environment suited to signal reception; and the first reception control unit determines that the radio signal receiver is in an environment suited to signal reception when the illuminance detected by the illuminance detection circuit is greater than or equal to a preset second threshold value, and determines the radio signal receiver is not in an environment suited to signal reception when the detected illuminance is less than the second threshold value.

19. The radio signal receiver described in claim 1, wherein:

the signal is a satellite signal.

20. A radio signal receiving method of a radio signal receiver that receives a signal, comprising:

a first reception control step of, if a current time is not a previously set scheduled reception time, receiving the signal when the radio signal receiver is determined to be in an environment suited to signal reception;

a second reception control step, independent of the first reception control step, of receiving the signal at the previously set scheduled reception time irrespective of any determination regarding whether the radio signal receiver is an environment suited to signal reception; and a switching step of switching between the first reception control step and the second reception control step.

* * * * *